US006757924B2

(12) United States Patent
Goodwin et al.

(10) Patent No.: US 6,757,924 B2
(45) Date of Patent: Jul. 6, 2004

(54) BED HAVING A REMOVABLE FOOT SECTION

(75) Inventors: Brent Goodwin, Batesville, IN (US); Matthew W. Weismiller, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 6 days.

(21) Appl. No.: 10/253,346

(22) Filed: Sep. 24, 2002

(65) Prior Publication Data

US 2003/0019039 A1 Jan. 30, 2003

Related U.S. Application Data

(63) Continuation-in-part of application No. 09/586,443, filed on Jun. 2, 2000, now Pat. No. 6,470,520, which is a continuation-in-part of application No. 09/379,446, filed on Aug. 23, 1999, now Pat. No. 6,408,464.

(60) Provisional application No. 60/325,690, filed on Sep. 28, 2001.

(51) Int. Cl.[7] ..... A61G 7/015

(52) U.S. Cl. ..... 5/602; 5/624

(58) Field of Search ..... 5/602, 620, 621, 5/624; 292/152, 153, 303, 304

(56) References Cited

U.S. PATENT DOCUMENTS

| | | | | |
|---|---|---|---|---|
| 388,995 | A | 9/1888 | Moxham | 72/338 |
| 964,170 | A | 7/1910 | Leonard | 5/618 |
| 2,067,891 | A | 1/1937 | Comper | 5/624 |
| 2,120,732 | A | 6/1938 | Comper et al. | 5/602 |
| 2,257,491 | A | 9/1941 | Armstrong | 5/602 |
| 2,275,973 | A | 3/1942 | Marchbanks | 5/649 |
| 2,306,031 | A | 12/1942 | Anderson et al. | 5/602 |
| 2,381,633 | A | 8/1945 | Young | 292/304 |
| 2,605,151 | A | 7/1952 | Shampaine | 5/602 |
| 2,658,211 | A | 11/1953 | Bendersky | 5/641 |
| 2,754,142 | A | 7/1956 | Baker | 292/304 |
| 2,757,058 | A | 7/1956 | Broesel | 5/624 |
| 2,766,463 | A | 10/1956 | Bendersky | 5/623 |
| 2,832,655 | A | 4/1958 | Adolphson | 5/602 |
| 2,872,259 | A | 2/1959 | Thorpe | 5/613 |

(List continued on next page.)

FOREIGN PATENT DOCUMENTS

| | | |
|---|---|---|
| DE | 3500313 | 7/1895 |
| DE | 2324486 | 12/1973 |
| EP | 0 681 799 B1 | 8/1998 |
| FR | 2666013 | 2/1992 |
| FR | 1518724 | 12/1996 |
| GB | 2225228 A | 5/1990 |
| JP | 56-109663 | 8/1981 |
| JP | 60-85749 | 5/1985 |
| JP | 60-195018 | 12/1985 |
| JP | 61-22577 | 6/1986 |
| JP | 61-119257 | 6/1986 |
| JP | 61-168351 | 7/1986 |
| JP | 61-44019 | 10/1986 |
| JP | 61-50626 | 11/1986 |
| JP | 2-147120 | 12/1990 |
| JP | 2-297366 | 12/1990 |
| JP | 2-297367 | 12/1990 |
| JP | 2-297368 | 12/1990 |
| JP | 3-4808 | 1/1991 |
| JP | 3-4809 | 1/1991 |
| JP | 5-31145 | 2/1993 |
| JP | 6-12755 | 4/1994 |
| JP | 6-506850 | 8/1994 |
| JP | 7-112012 | 5/1995 |
| WO | WO 92/18082 | 10/1992 |

*Primary Examiner*—Robert G. Santos
(74) *Attorney, Agent, or Firm*—Bose McKinney & Evans LLP

(57) ABSTRACT

A patient support apparatus including a patient support and a removable section. A locking mechanism includes interactive members supported by the patient support and the removable section for releasably securing the removable section to the patient support.

28 Claims, 20 Drawing Sheets

U.S. PATENT DOCUMENTS 3,100,129 A 8/1963 Adolphson ..... 297/423.22
3,167,789 A 2/1965 Wicks ..... 5/81.1 HS
3,220,022 A 11/1965 Nelson ..... 5/618
3,226,105 A 12/1965 Weickgenannt ..... 5/624
3,227,440 A 1/1966 Scott ..... 5/618
3,318,596 A 5/1967 Herzog ..... 5/619
3,334,951 A 8/1967 Douglass, Jr. et al. ..... 312/209
3,492,679 A 2/1970 Drew ..... 5/616
3,599,963 A 8/1971 Grover ..... 5/618
3,813,091 A 5/1974 Metzger ..... 5/613
3,817,512 A 6/1974 Torrey ..... 5/632
3,845,945 A 11/1974 Lawley et al. ..... 5/602
3,868,103 A 2/1975 Pageot et al. ..... 5/614
3,997,926 A 12/1976 England ..... 5/610
4,025,972 A 5/1977 Adams et al. ..... 5/616
4,097,939 A 7/1978 Peck et al. ..... 5/611
4,139,917 A 2/1979 Fenwick ..... 5/602
4,148,472 A 4/1979 Rais et al. ..... 5/601
4,225,126 A 9/1980 Lee ..... 5/613
4,225,127 A 9/1980 Strutton ..... 5/602
4,247,091 A 1/1981 Glowacki et al. ..... 5/602
4,323,060 A 4/1982 Pecheux ..... 602/33
4,333,638 A 6/1982 Gillotti ..... 5/613
4,336,965 A 6/1982 Lipp ..... 297/423.36
4,395,071 A 7/1983 Laird ..... 297/440.21
4,411,035 A 10/1983 Fenwick ..... 5/602
4,426,071 A 1/1984 Klevstad ..... 5/602
4,552,348 A 11/1985 Forssmann et al. ..... 4/560
4,564,164 A 1/1986 Allen et al. ..... 248/118
4,577,730 A 3/1986 Porter ..... 188/67
4,615,058 A 10/1986 Feldt ..... 5/602
4,632,349 A 12/1986 Anstey ..... 248/281.11
4,639,954 A 2/1987 Speed ..... 5/602
4,682,376 A 7/1987 Feldt ..... 5/602
4,688,780 A 8/1987 Hanz ..... 5/621
4,698,837 A 10/1987 Van Steenburg ..... 378/208
4,724,555 A 2/1988 Poehner et al. ..... 5/624
4,805,249 A 2/1989 Usman et al. ..... 5/619
4,807,618 A 2/1989 Auchinleck et al. ..... 128/878
4,860,394 A 8/1989 Benessis et al. ..... 5/611
4,882,797 A 11/1989 Failor et al. ..... 5/613
4,886,258 A 12/1989 Scott ..... 5/624
4,894,876 A 1/1990 Fenwick ..... 5/602
4,898,491 A 2/1990 Van Steenburg ..... 403/96
4,940,218 A 7/1990 Akcelrod ..... 5/621
4,968,013 A 11/1990 Kuck ..... 5/600
4,993,762 A 2/1991 Rogers et al. ..... 292/303
5,039,167 A 8/1991 Sweet ..... 297/423.37
5,060,327 A 10/1991 Celestina et al. ..... 5/662
5,104,363 A 4/1992 Shi ..... 482/73
5,109,554 A 5/1992 Borders et al. ..... 5/602
5,116,008 A 5/1992 Allen ..... 248/246.01
5,129,116 A 7/1992 Borders et al. ..... 5/602
5,129,117 A 7/1992 Celestina et al. ..... 5/602
5,134,737 A 8/1992 Wyman ..... 5/600
5,134,739 A 8/1992 Gaffe et al. ..... 5/648
5,148,562 A 9/1992 Borders et al. ..... 5/610
5,157,800 A 10/1992 Borders ..... 5/602
5,201,087 A 4/1993 Wickham et al. ..... 5/610
D336,577 S 6/1993 Celestina et al. ..... D6/503
D336,578 S 6/1993 Celestina ..... D6/503
5,214,812 A 6/1993 Bartow et al. ..... 5/624
5,226,187 A 7/1993 Borders et al. ..... 5/602
5,329,657 A 7/1994 Bartley et al. ..... 5/617
5,331,698 A 7/1994 Newkirk et al. ..... 5/602
5,362,302 A 11/1994 Jensen et al. ..... 601/24
5,398,357 A 3/1995 Foster ..... 5/619
5,423,097 A 6/1995 Brulé et al. ..... 5/617
5,454,126 A 10/1995 Foster et al. ..... 5/618
5,472,412 A 12/1995 Knoth ..... 602/26
5,479,666 A 1/1996 Foster et al. ..... 5/624
5,481,770 A 1/1996 Ahlsten ..... 5/625
5,560,577 A 10/1996 Keselman ..... 248/279.1
5,628,078 A 5/1997 Pennington et al. ..... 5/618
5,636,899 A 6/1997 Schiff et al. ..... 297/411.36
5,645,079 A 7/1997 Zahiri et al. ..... 5/610
5,661,859 A 9/1997 Schaefer ..... 5/621
5,692,255 A 12/1997 Canfield ..... 5/505.1
5,740,571 A 4/1998 Tyra ..... 5/624
5,740,572 A 4/1998 Hannant ..... 5/624
5,774,914 A 7/1998 Johnson et al. ..... 5/602
5,778,467 A 7/1998 Scott et al. ..... 5/613
5,802,641 A 9/1998 Van Steenburg ..... 5/648
5,862,549 A 1/1999 Morton et al. ..... 5/610
5,878,748 A 3/1999 Garth et al. ..... 128/869
5,913,774 A 6/1999 Feddema ..... 5/618
5,926,878 A 7/1999 Morton et al. ..... 5/602
5,941,175 A 8/1999 Bannister ..... 108/20
5,961,085 A 10/1999 Navarro et al. ..... 248/279.1
6,058,534 A 5/2000 Navarro et al. ..... 5/648
6,141,806 A 11/2000 Bobey et al. ..... 5/600
6,408,464 B1 * 6/2002 Weismiller et al. ..... 5/602
6,470,520 B1 * 10/2002 Weismiller et al. ..... 5/602
2003/0019039 A1 * 1/2003 Goodwin et al. ..... 5/602

* cited by examiner

BED HAVING A REMOVABLE FOOT SECTION

CROSS-REFERENCE TO RELATED APPLICATIONS

This application is a continuation-in-part of U.S. patent application Ser. No. 09/586,443, filed on Jun. 2, 2000, now U.S. Pat. No. 6,470,520 which is a continuation-in-part of U.S. patent application Ser. No. 09/379,446, filed on Aug. 23, 1999, now U.S. Pat. No. 6,408,464, and further claims the benefit of U.S. Provisional Patent Application Serial No. 60/325,690, filed Sep. 28, 2001, the disclosures of which are expressly incorporated by reference herein.

BACKGROUND OF THE INVENTION

This invention relates to a birthing bed, and particularly to a removable foot section for a birthing bed. More particularly, this invention relates to an apparatus for attaching a removable foot section to a birthing bed.

Conventional birthing beds typically have a detachable foot section. The removal of the foot section permits a caregiver to slide a stool into the space vacated by the foot section so as to be in position to assist in delivery. After delivery, the foot section is reattached to a patient support deck (hereafter, "the patient support") of the birthing bed. The present invention comprises improvements to such beds.

SUMMARY OF THE INVENTION

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the removable head section or the removable side panel, as the case may be, extends generally horizontally in the plane of the patient support.

According to an embodiment of the present invention, a patient support apparatus comprises a patient support having a first generally planar surface, a removable section having a second generally planar surface, and an attachment mechanism configured to secure the removable section to the patient support such that the second planar surface of the removable section is aligned generally parallel to the first planar surface of the patient support only when the removable section is fully inserted into the patient support and latched to the patient support.

According to another embodiment of the invention, the foot section must be inserted into the bed at an angle relative to the patient support, and is configured to become generally coplanar with the patient support only when it is fully inserted into the bed.

According to still another embodiment, if the foot section is inserted only a part of the way into the bed and let go, it will assume a non-coplanar position with respect to the patient support. The foot section will become generally coplanar with the patient support only when it is fully inserted into the bed.

According to yet another illustrated embodiment of the present invention, a patient support apparatus comprises a patient support, a removable section, and a latch having interactive members coupled to the patient support and the removable section. The removable section is movable between a first position wherein the removable section is coupled to the patient support by the interactive members and a second position wherein the removable section is spaced apart from the patient support. The removable section is movable from the second position to the first position along an inclined path of travel having both horizontal and vertical components relative to a ground surface.

According to a further illustrated embodiment of the present invention, a patient support apparatus comprises a patient support, and a removable section movable between a first position wherein the removable section is coupled to the patient support and a second position wherein the removable section is spaced apart from the patient support. The patient support apparatus further comprises a locking mechanism including a detent coupled to one of the patient support and the removable section and a detent release coupled to the other of the removable section and the patient support, wherein the detent release is selectively connected to the detent when the removable section is in the first position.

In still yet another illustrated embodiment of the present invention, a patient support apparatus comprises a patient support, a removable section, and an attachment mechanism including cooperating engagement members coupled to the patient support and the removable section. The removable section is movable between a first position wherein the removable section is connected to the patient support by the engagement members and a second position wherein the removable section is spaced apart from the patient support. The patient support apparatus further comprises a locking mechanism including a locking recess supported by the removable section and a detent supported by the patient support, the detent movable between a first position received within the locking recess and a second position in spaced relation to the locking recess when the removable section is coupled to the patient support by the engagement members.

According to a further illustrated embodiment of the present invention, a patient support apparatus comprises a patient support, a removable section movable between a first position wherein the removable section is coupled to the patient support and a second position wherein the removable section is spaced apart from the patient support. The patient support apparatus further comprises a latch coupled to the patient support and movable between a first, locked position and a second, unlocked position. A latch release is coupled to the removable section, wherein movement of the latch release moves the latch between the locked position and the unlocked position when the removable section is in the first position.

According to yet another illustrated embodiment of the present invention, a removable section for selective coupling with a patient support comprises a body, a guide member supported by the body, and a handle supported for sliding movement by the guide member. The removable section further comprises a locking mechanism including an interactive member operably connected to the handle, wherein movement of the handle moves the interactive member.

Additional features of the present invention will become apparent to those skilled in the art upon a consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the head section or the side panel, as the case may be, extends generally horizontally in the plane of the patient support.

Figure 1:
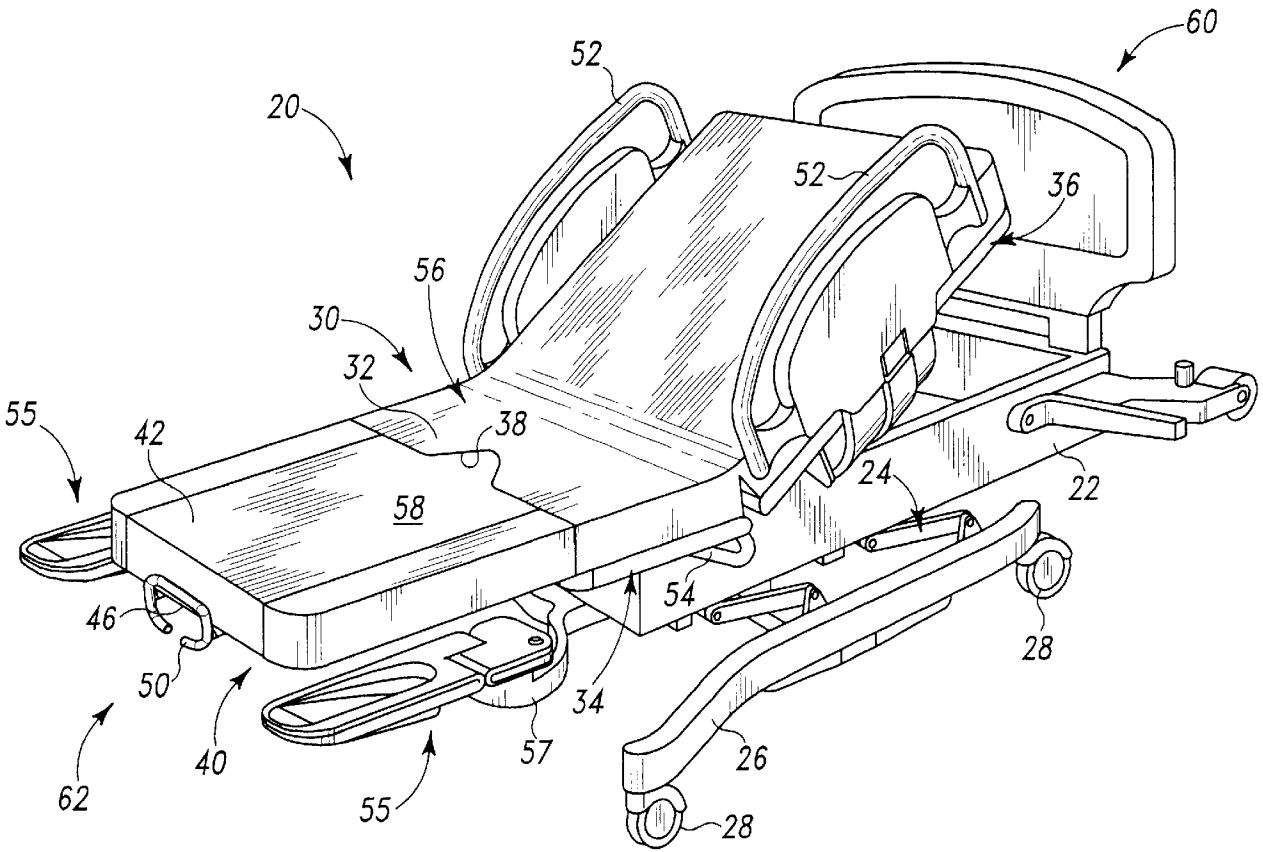
FIG. 1 is a perspective view of a birthing bed showing a removable foot section fully inserted into the bed and latched to the patient support, the foot section extending generally horizontally in the plane of the patient support, and further showing a head section raised to a reclining position.
Figure 2:
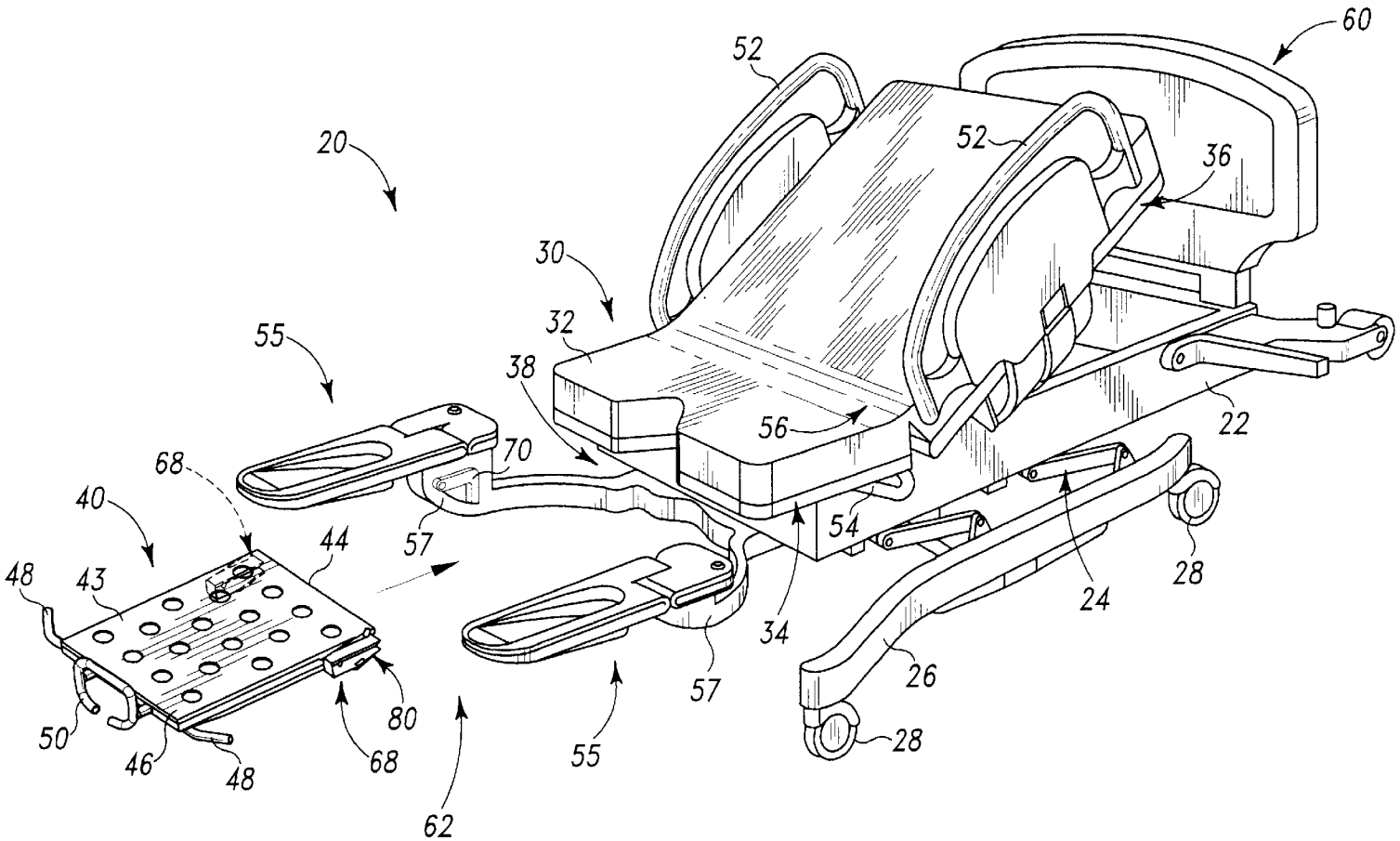
FIG. 2 is a perspective view of a birthing bed similar to FIG. 1, but showing the foot section detached from the seat section.
Figure 3:
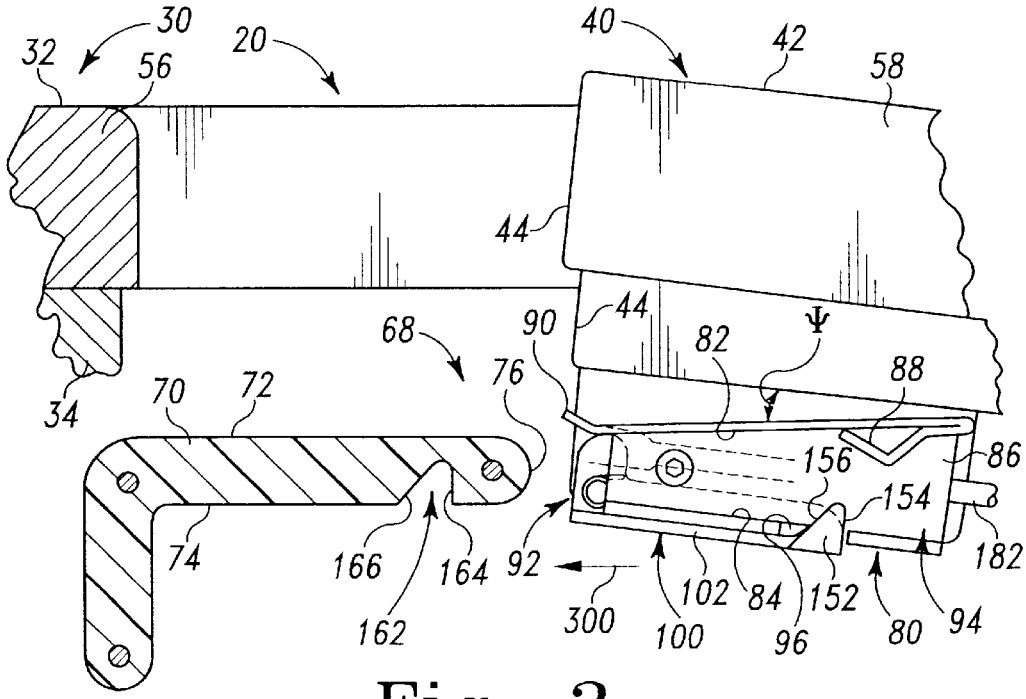
FIG. 3 is a side elevational view, partly in section, of a portion of the birthing bed showing a foot section attachment mechanism in accordance with an embodiment of this invention, the foot section attachment mechanism including a guide member coupled to the main frame and configured for extending into a diverging guide channel coupled to the foot section when the foot section is inserted into the birthing bed, the diverging guide channel including a ramp portion near the foot end thereof which is configured to engage the guide member when the foot section is inserted into the birthing bed to cause the foot section to align with the patient support, a latch bar pivotally coupled to the foot section is configured to lock the foot section to the patient support when the foot section is fully inserted into the birthing bed and the foot section is aligned with the patient support.
Figure 4:
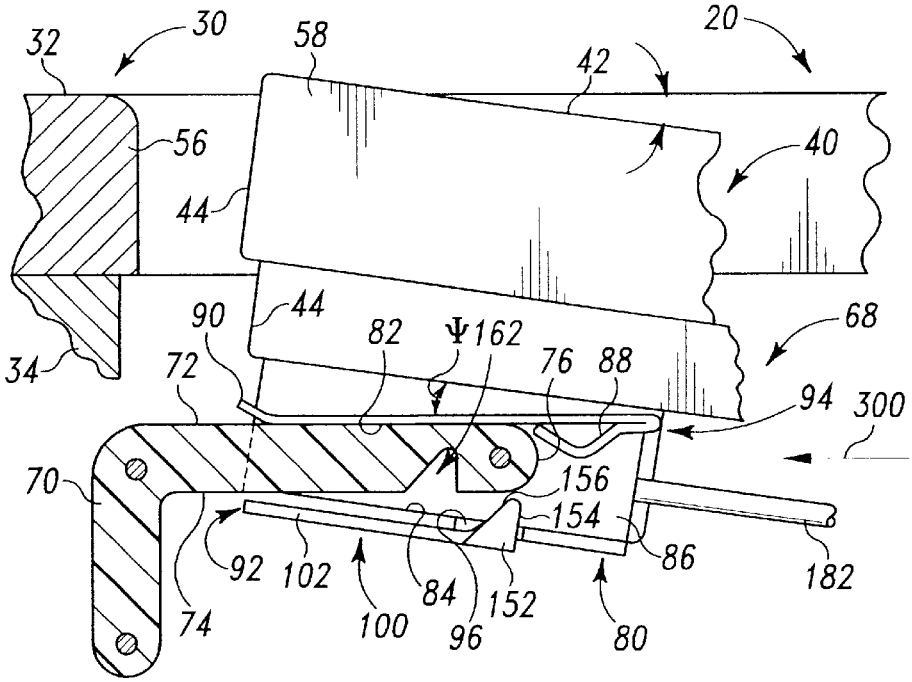
FIGS. 4–6 are side elevational views, partly in section, similar to FIG. 3, and showing a sequence of steps involved in attaching the foot section to the patient support.
Figure 5:
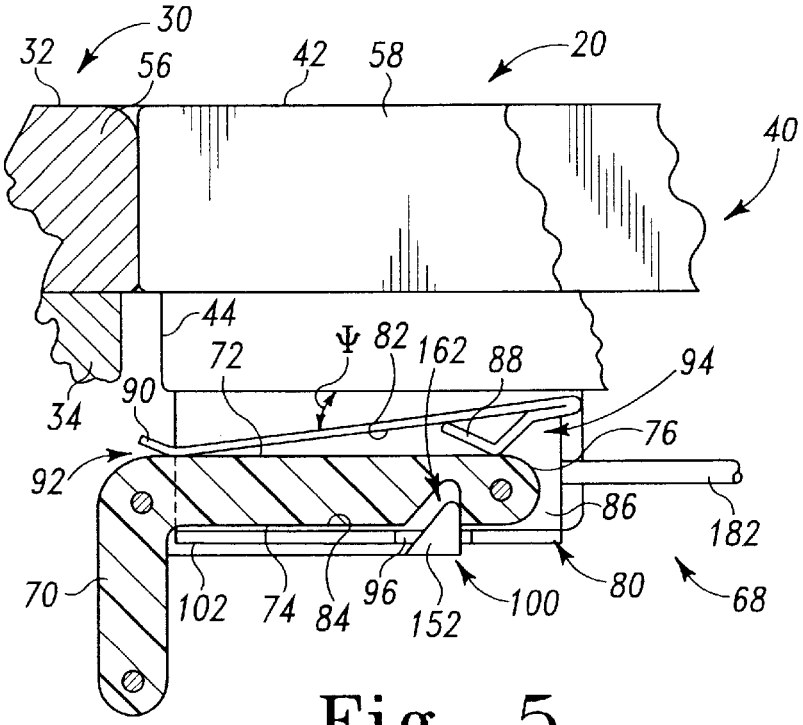

Referring to FIGS. 1 and 2, an illustrative birthing bed 20 is shown having a main frame 22 mounted by a parallelogram linkage 24 to a base frame 26. The base frame 26 has casters 28 for supporting the bed 20 on the floor. The bed 20 includes a patient support deck 30 (hereafter, "the patient support 30") for supporting a mattress 56 on which a patient can rest. The patient support 30 includes a generally horizontal seat section 34 rigidly mounted to the main frame 22. A head section 36 is pivotally mounted to the seat section 34 so that the bed 20 can be articulated between a generally horizontal lying-down position defining a generally horizontal, upwardly-facing surface 32 in the plane of the seat section 34, a generally reclining sitting-up position inclined with respect to the seat section 34, and an infinite number of intermediate positions in between. The seat section 34 includes a central opening 38 into which a removable foot section 40 is inserted such that an upper surface 42 of the foot section 40 extends generally horizontally in the plane of the patient support surface 32 when the foot section 40 is fully inserted into the central opening 38 and latched to the seat section 34. A detachable portion 58 of the mattress 56 is secured to the foot section 40 by any suitable means—such as a plurality of Velcro® fasteners, snaps, ties or the like. Detachable mattress portion 58 is removed from foot section 40 in FIG. 2. Top surface 43 of foot section 40 is configured to be aligned in substantially the same plane as seat section 34 of patient support 30 only when the foot section 40 is fully inserted and latched as discussed below.

Figure 8:
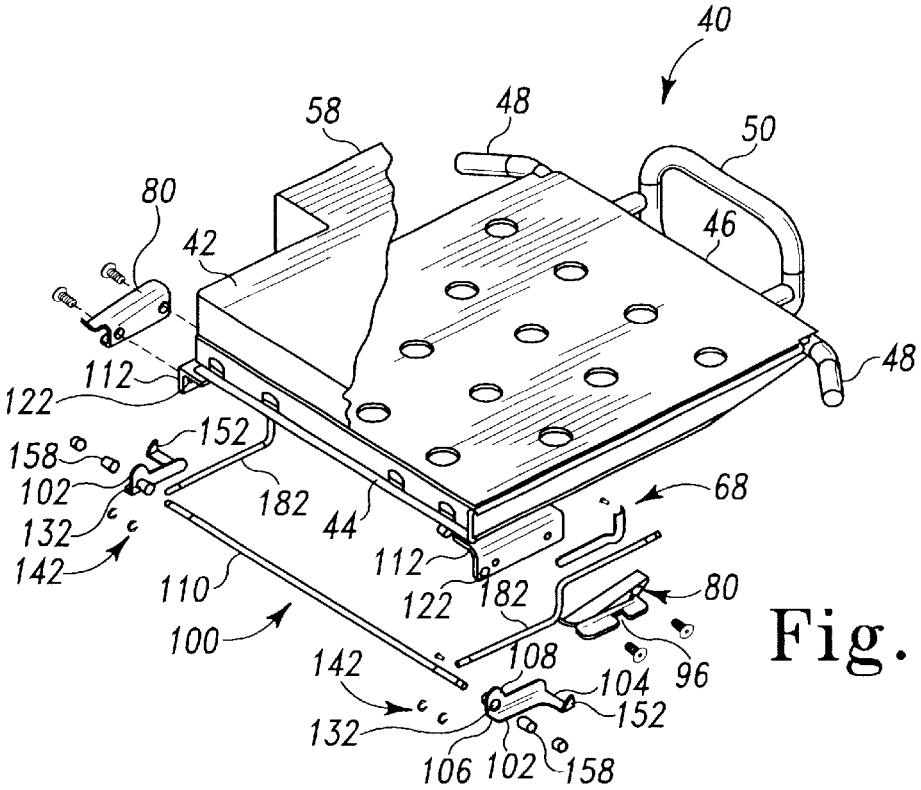
FIG. 8 is an exploded view of the foot section and the foot section locking mechanism.

As shown in FIGS. 2 and 8, the foot section 40 includes a pair of handles 48, one on each side, adjacent to a foot end 46 of the foot section 40. The handles 48 assist the caregiver to pull the foot section 40 away from the bed 20 so that the foot section 40 is detached from the patient support 30 and stored. The foot section 40 includes a floor stand 50 adjacent to the foot end 46 for vertically supporting the foot section 40 on the floor. As used in this description with reference to the bed 20, the phrase "head end" will be used to denote the end of any referred-to object that is positioned to lie nearest the head end 60 of the bed 20, and the phrase "foot end" will be used to denote the end of any referred-to object that is positioned to lie nearest the foot end 62 of the bed 20.

The head section 36 has two siderails 52 mounted thereon, one on each side of the head section 36. Mounted to the underside of the seat section 34 are labor grips 54, one on each side of the bed 20. The labor grips 54 have two principal positions—a vertical operative position projecting substantially perpendicularly to the seat section 34, and a horizontal out-of-the-way storage position tucked underneath the seat section 34. In their vertical operative positions, the labor grips 54 can be gripped by the mother to assist her in generating maximum thrust during delivery. A pair of pivotable foot supports 55 are coupled to supports 57.

FIGS. 3–6 illustrate a foot section attachment mechanism 68 in accordance with an embodiment of the present invention. The foot section attachment mechanism 68 includes two guide members 70 coupled to the supports 57 of the main frame 22, one on each side of the bed 20, and two guide tracks 80 coupled to the foot section 40, one on each side of the foot section 40. Although the guide members 70 are coupled to the main frame 22 in this particular embodiment, they may very well be coupled instead to the seat section 34 which is rigidly mounted to the main frame 22. Since the construction and the operation of the two guide members 70 and the two guide tracks 80 is similar, only one guide member and one guide track will be described herein in the interest of brevity. It will be understood that the construction and the operation of the other guide member and the other guide track is similar. The two guide members 70 and the two guide tracks 80 are sometimes referred to herein as the cooperating engagement members.

The guide track 80 includes a lip or ramp portion 90 near its entrance 92. The ramp portion 90 engages a leading edge 76 of the guide member 70 during insertion of the foot section 40 into the bed 20 to direct the guide member 70 into the guide track 80. The guide member 70 includes a first upwardly-facing surface portion 72 on an upper side thereof and a second downwardly-facing surface portion 74 on an underside thereof, both surface portions 72 and 74 extending generally parallel to the generally horizontal, upwardly-facing surface 32 of the seat section 34. The guide track 80 coupled to the foot section 40 includes a first downwardly-facing surface portion 82 on an upper side thereof extending generally at an angle ψ with respect to the upwardly-facing surface 42 of the foot section 40 (illustratively, between about 10° and about 30°), and a second upwardly-facing surface portion 84 on a lower side thereof extending generally parallel to the upwardly-facing surface 42 of the foot section 40. The first downwardly-facing surface portion 82 and the second upwardly-facing surface portion 84 of the guide track 80 form a diverging guide channel 86 into which the guide member 70 extends when the foot section 40 is inserted into the bed 20 in the direction of arrow 300. The first generally-inclined, downwardly-facing surface portion 82 of the guide track 80 includes a downwardly-projecting ramp portion 88 near its foot end 94 (sometimes referred to herein as "the inner end"), which engages the leading edge 76 of the guide member 70 when the foot section 40 is inserted into the bed 20 to cause the first generally-inclined, downwardly-facing surface portion 82 of the guide track 80 to move away from the first generally-horizontal, upwardly-facing surface portion 72 of the guide member 70, and to cause the second generally-parallel, upwardly-facing surface portion 84 of the guide track 80 to move closer to the second generally-horizontal, downwardly-facing surface portion 74 of the guide member 70 to, in turn, cause the upwardly-facing surface 42 of the foot section 40 to align in substantially the same plane with the upwardly-facing surface 32 of the patient support 30.

Figure 7:
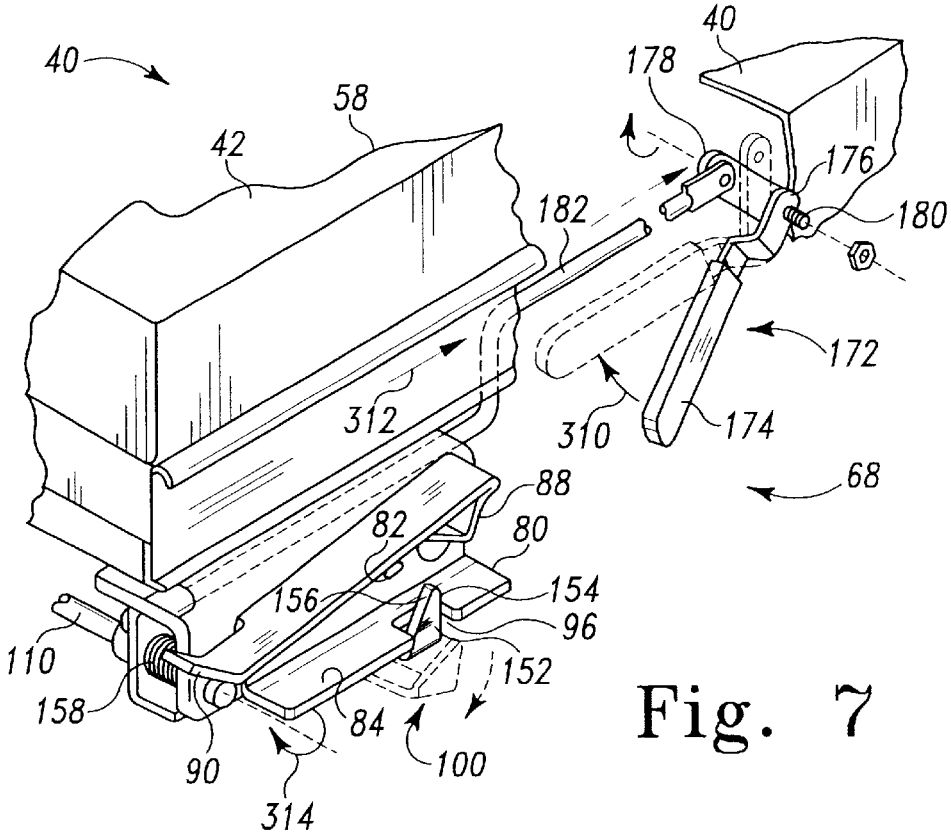
FIG. 7 is a perspective view of the foot section, partly broken away; showing a release handle coupled to the latch bar for releasing the foot section from the patient support.

The foot section 40 includes a foot section locking mechanism 100 best shown in FIGS. 7 and 8. The foot section locking mechanism 100 locks the foot section 40 to the patient support 30 when the foot section 40 is fully inserted into the bed 20 and the upwardly-facing surface 42 of the foot section 40 is aligned with the upwardly-facing surface 32 of the patient support 30. The foot section locking mechanism 100 includes two latch bars 102 pivotally mounted on opposite sides of the foot section 40 by means of a transversely-extending connecting rod 110. Attached to the underside of the foot section 40 near the head end 44 thereof are two downwardly-projecting brackets 112, one on each side of the foot section 40. As shown in FIG. 8, the two ends of the connecting rod 10 are passed through two slightly oversized openings 122 in the downwardly projecting brackets 112 and through two slightly oversized openings 132 in the two latch bars 102, and securely held in place by two sets of C-shaped retaining rings 142—one on each side of the foot section 40.

Since the two latch bars 102 are mirror images of each other, only one latch bar will be described herein in the interest of brevity. It will be understood that the construction and operation of the other latch bar is similar. The latch bar 102 is movable between a first operative position where a generally triangular portion 152 coupled to a first end 104 of the latch bar 102 enters a generally triangular retaining slot 162 in the guide member 70 through an opening 96 in the second upwardly-facing surface portion 84 of the guide track 80 to lock the foot section 40 to the patient support 30 when the foot section 40 is fully inserted into the bed 20 and the upwardly-facing surface 42 of the foot section 40 is aligned with the upwardly-facing surface 32 of the patient support 30, and a second inoperative position where the triangular portion 152 is out of the retaining slot 162 to release the foot section 40. A spring 158 coupled to the latch bar 102 biases the latch bar 102 toward its first operative position. Illustratively, in this embodiment, the triangular portion 152 coupled to the first end 104 of the latch bar 102 is formed integrally therewith.

The triangular portion 152 includes a first generally vertical side 154 adapted for engaging a first generally vertical side 164 of the retaining slot 162, and a second generally inclined side 156 adapted for engaging a second generally inclined side 166 of the retaining slot 162. During attachment of the foot section 40 to the rest of the bed 20, the inclined side 156 of the latch bar 102 cams against the leading edge 76 of the guide member 70 thereby pivoting the latch bar 102 downwardly against the bias of the spring 158 until the triangular portion 152 of the latch bar 102 aligns with the retaining slot 162 in the guide member 70 at which point the spring 158 biases the latch bar 102 upwardly so that the triangular portion 152 is received in the retaining slot 162. Thus, the spring 158 coupled to the latch bar 102 inserts the triangular portion 152 into the retaining slot 162 in the guide member 70 to lock the foot section 40 to the patient support 30 when the foot section 40 is fully inserted into the bed 20 and the upwardly-facing surface 42 of the foot section 40 is aligned with the upwardly-facing surface 32 of the patient support 30. The first vertical side 154 of the triangular portion 162 of the latch bar 102 bears against the first vertical side 164 of the retaining slot 162 in the guide member 70 to prevent extraction of the foot section 40 from the bed 20.

Figure 6:
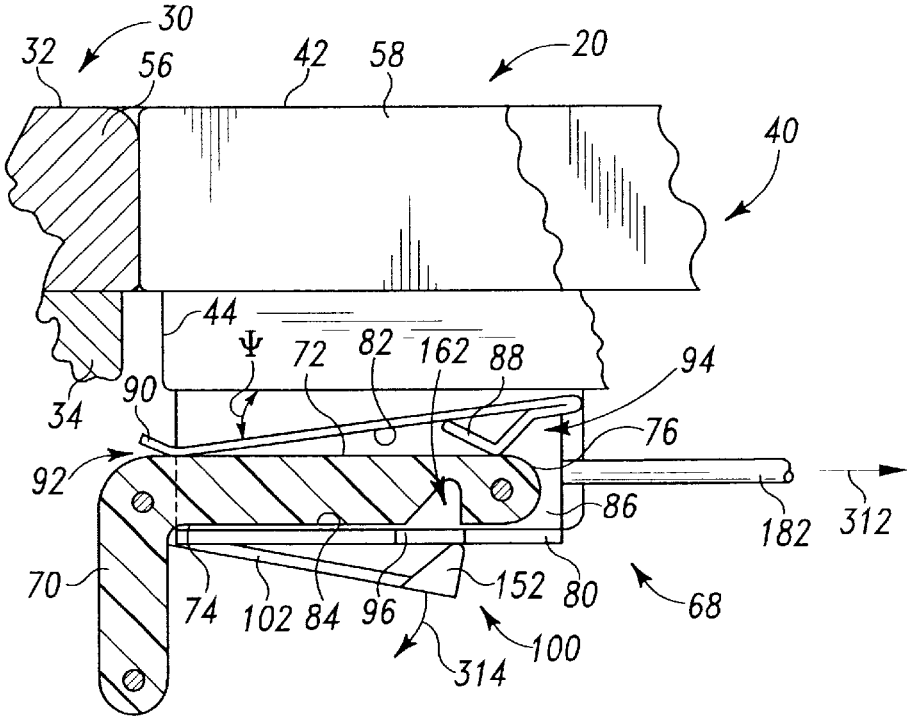

As indicated before, the foot section 40 is detachable from the patient support 30. The removal of the foot section 40 permits a caregiver to slide a stool into the space vacated by the foot section 40 to be in position to assist in delivery. To this end, a foot section release handle 172 is mounted to the foot section 40 adjacent to its foot end 46 as shown in FIGS. 7 and 8. The foot section release handle 172 includes a first portion 174 providing a handle, a middle portion 176 pivotally coupled to the foot section 40 about a transversely-extending pivot pin 180, and a third portion 178 pivotally coupled to a third portion 108 of the latch bar 102 by a longitudinally-extending coupling rod 182. When the release handle 172 is rotated clockwise in the direction of arrow 310, the coupling rod 182 moves outwardly in the direction of arrow 312. As shown in FIGS. 6 and 7, the outward motion of the coupling rod 182, in turn, causes the latch bar 102 to turn clockwise in the direction of arrow 314, whereby the triangular portion 152 coupled to latch bar 102 disengages from the retaining slot 62 to free the foot section 40.

Thus, the foot section attachment mechanism 68 is configured such that the upper surface 42 of the foot section 40 will not become parallel with the upper surface 32 of the seat section 34 until the foot section 40 is fully inserted into the opening 38 in the seat section 34. Upon full insertion of the foot section 40 into the opening 38, the locking mechanism 100 automatically locks the foot section 40 to the rest of the bed 20. Therefore, the foot section attachment mechanism 68 provides the caregiver with a visual indication (i.e., the orientation of the upper surface 42 of the foot section 40) regarding whether the foot section 40 is properly attached to the rest of the bed 20.

Figure 9:
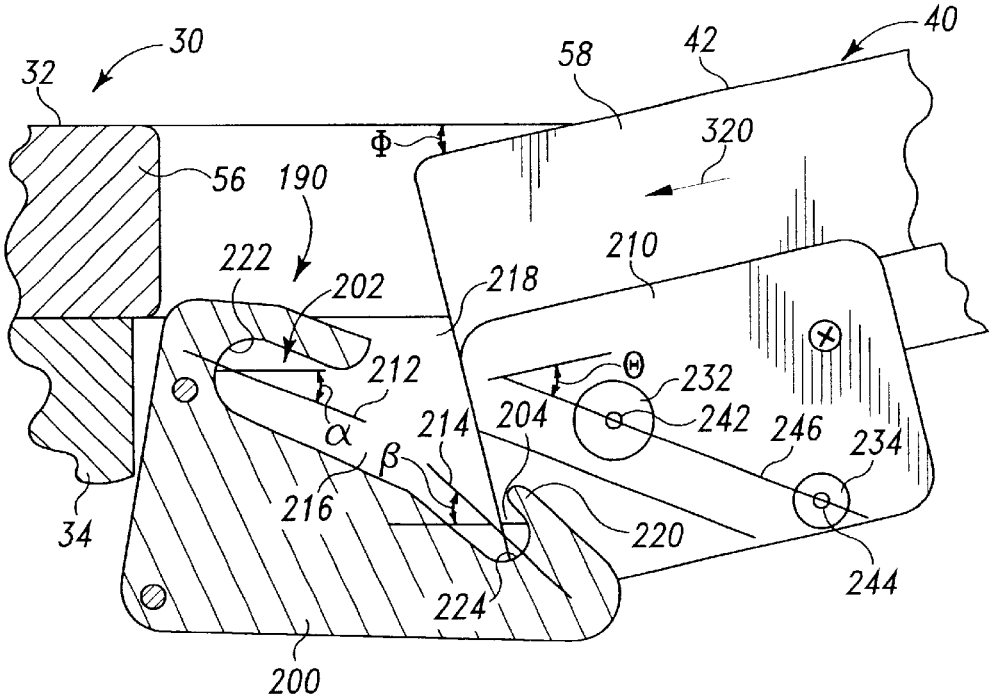
FIGS. 9 and 10 are side elevational views, partly in section, of an alternative embodiment of the present invention comprising two posts attached to the foot section configured for insertion into two oppositely-disposed retaining slots in the patient support to lock the foot section to the patient support, the foot section not aligning with the patient support until the foot section is completely inserted and locked to the patient support.
Figure 10:
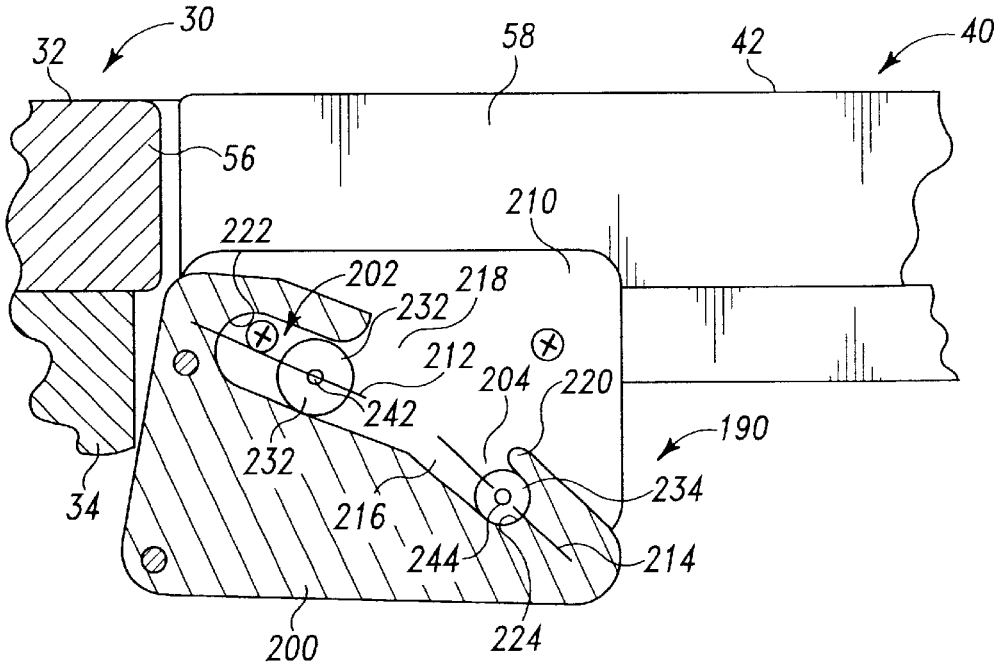

An alternative embodiment of the present invention is shown in FIGS. 9 and 10. As shown therein, a foot section attachment mechanism 190 includes two guide members 200 coupled to the main frame 22, one on each side of the bed 20, and two brackets 210 coupled to the removable foot section 40, one on each side of the foot section 40. Although the guide members 200 are coupled to the main frame 22 in this particular embodiment, they may very well be coupled instead to the seat section 34 which is rigidly mounted to the main frame 22. Since the construction and the operation of the two guide members 200 and the two brackets 210 is similar, only one guide member and one bracket will be described herein. It will be understood that the construction and the operation of the other guide member and the other bracket is similar. The two guide members 200 and the two brackets 210 are sometimes referred to herein as the cooperating engagement or interactive members.

The guide member 200 coupled to the main frame 22 includes two oppositely-disposed retaining slots—a leading forwardly-extending retaining slot 202 extending downwardly toward the foot end 62 of the bed 20, and a trailing rearwardly-extending retaining slot 204 extending upwardly toward the head end 60 of the bed 20. The bracket 210 coupled to the foot section 40, on the other hand, includes two posts—a leading post 232 near the head end 44 of the foot section 40 and a trailing post 234 near the foot end 46 of the foot section 40. The two retaining slots 202 and 204 form a passageway 216 in the guide member 200 that terminates into an opening 218 through which the two posts 222 and 224 enter the two retaining slots 202 and 204 respectively when the foot section 40 is inserted into the bed 20 to lock the foot section 40 to the patient support 30.

As shown in FIGS. 9 and 10, the leading forwardly-extending retaining slot 202 extending downwardly toward the foot end 62 of the bed 20 has a central axis 212 that subtends a first angle a relative to the upwardly-facing surface 32 of the patient support 30. On the other hand, the trailing rearwardly-extending retaining slot 204 extending upwardly toward the head end 60 of the bed 20 has a central axis 214 that subtends a second angle $\beta$ relative to the upwardly-facing surface 32 of the patient support 30 that is larger than the first angle $\alpha$. Illustratively, the first angle $\alpha$ is about 30°, and the second angle $\beta$ is about 45°. The two posts 232 and 234 are mounted to the bracket 210 by respective transversely-extending bolts 242 and 244. The two bolts 242 and 244 lie in a plane 246 that forms a third angle $\theta$ relative to the upwardly-facing surface 42 of the foot section 40 that lies between the first angle a and the second angle $\beta$. Illustratively, the third angle $\theta$ between the plane 246 and the upwardly-facing surface 42 of the foot section 40 is about 37.5°. In the embodiment shown, the leading post 232 is made larger than the trailing post 234, and likewise the leading retaining slot 202 is made larger than the trailing retaining slot 204. This arrangement of unequal posts 232 and 234 and unequal retaining slots 202 and 204 prevents the larger leading post 232 from inadvertently entering the smaller trailing retaining slot 204 during insertion and removal of the foot section 40 into and from the rest of the bed 20.

In operation, as shown in FIG. 9, the foot section 40 is inserted into the bed 20 in the direction of arrow 320 at an angle $\Phi$ about 30°, to insert the larger leading post 232 into the larger, forwardly-extending retaining slot 202 through the opening 218 in the guide member 200 during forward motion of the foot section 40 toward the head end 60 of the bed 20. After the foot section 40 is fully inserted into the bed 20 so that the larger leading post 232 engages the bottom portion 222 of the forwardly-extending retaining slot 202, it is pivoted downwardly about the larger leading post 232. This downward pivoting of the foot section 40 about the larger leading post 222 allows the smaller trailing post 234 to enter the smaller, rearwardly-extending retaining slot 204 through the opening 218 in the guide member 200. When the foot section 40 is let go thereafter, it moves slightly outwardly toward the foot end 62 as shown in FIG. 10 until the smaller trailing post 234 engages the bottom portion 224 of the rearwardly-extending retaining slot 204. This outward motion of the foot section 40 allows the upwardly-facing surface 42 of the foot section 40 to align with the upwardly-facing surface 32 of the patient support 30, and simultaneously locks the foot section 40 to the patient support 30.

On the other hand, when the foot section 40 is inserted horizontally into the bed 20 in the plane of the upwardly-facing surface 32 of the patient support 30, a lip portion 220 of the guide member 200 near the opening 218 blocks the entry of the trailing post 234 into the passageway 216 in the guide member 200. Thus, the lip portion 220 of the guide member 200 prevents a partial entry of the foot section 40 into the bed 20. The foot section 40 must be inserted into the bed 20 at a certain angle Φ relative to the upwardly-facing surface 32 of the patient support 30, and will become horizontal only when the foot section 40 is fully inserted into the bed 20 and locked in place.

In the particular embodiment described herein, the leading and trailing retaining slots 202 and 204 are illustratively formed in the guide member 200 secured to the main frame 22. However, the retaining slots 202 and 204 may very well be formed directly in the main frame 22 instead. Although two posts 232 and 234 are secured to the bracket 210 by bolts 242 and 244, the two posts 232 and 234 may be replaced by two rollers and pivotally secured to the bracket 210 by pivot pins instead. Also, the posts 232 and 234 may be directly mounted to the foot section 40.

Figure 11:
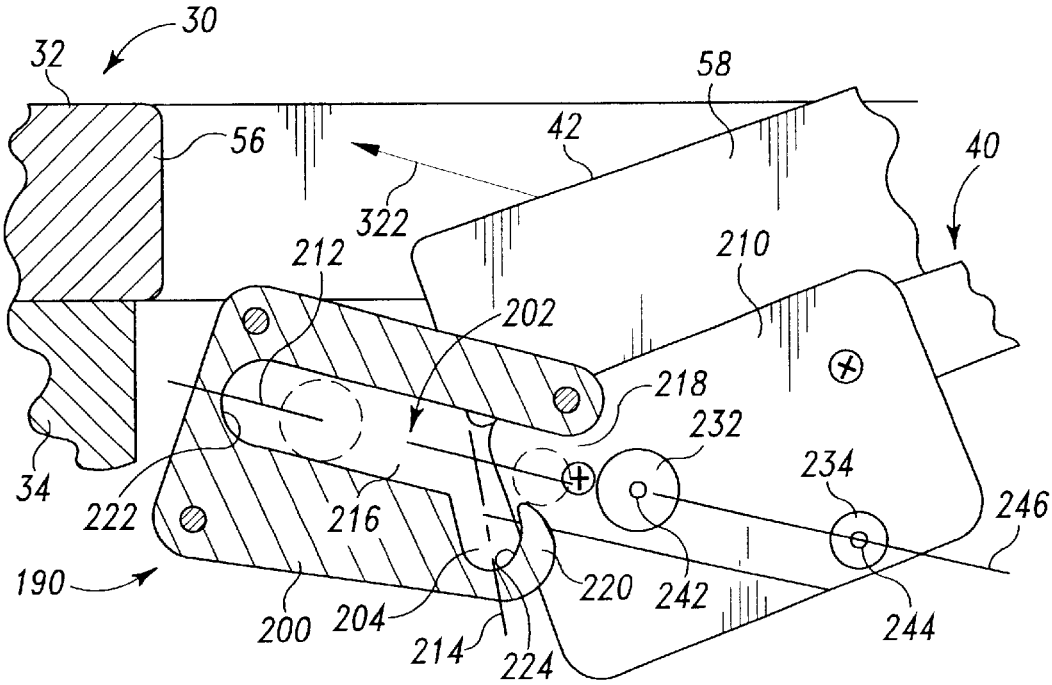
FIGS. 11 and 12 are side elevational views similar to FIGS. 9 and 10, partly in section, of a variation of the alternative embodiment shown in FIGS. 9 and 10.
Figure 12:
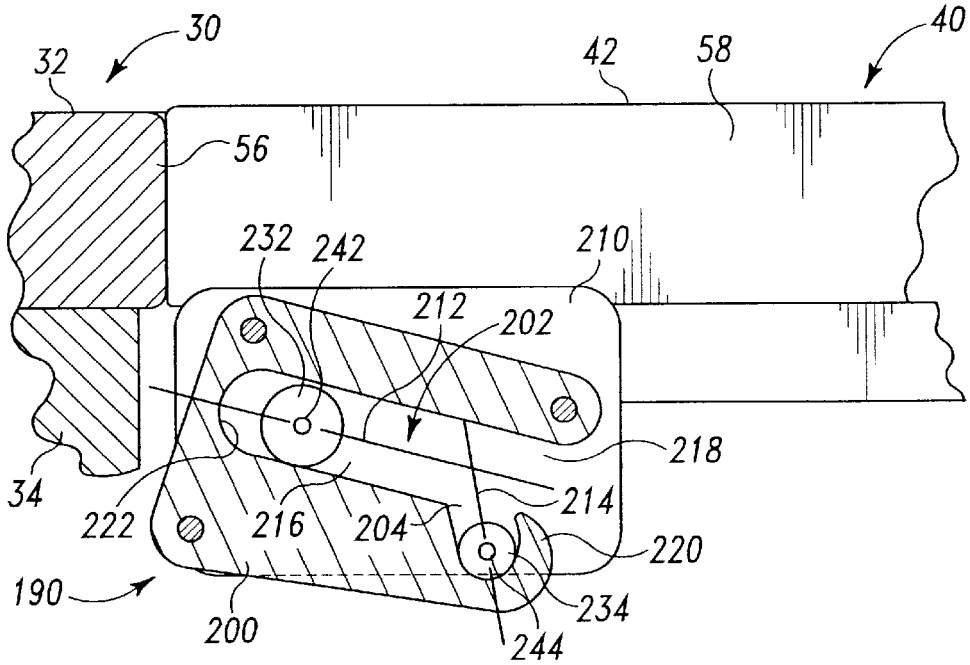

FIGS. 11 and 12 show a variation of the alternative embodiment of the foot section attachment mechanism 190 of FIGS. 9 and 10. The two posts 232 and 234 in the embodiment of FIGS. 11 and 12 are identical to those in the embodiment of FIGS. 9 and 10. The configuration of the retaining slots 202 and 204 is, however, slightly different. The operation of the embodiment of FIGS. 11 and 12 is, however, similar to the operation of the embodiment of FIGS. 9 and 10.

FIGS. 13–18 show an alternative embodiment of a foot section attachment mechanism 368 that is similar to the foot section attachment mechanism 68 shown in FIGS. 2–8. Those elements in FIGS. 13–18 identified by reference numbers identical to FIGS. 2–8 perform the same or similar function. The attachment mechanism 368 includes a first portion 370 coupled to supports 57 and a second portion 372 coupled to foot section 340. In the FIG. 13 embodiment, detachable mattress section 58 is shown removed from the foot section 340.

Figure 13:
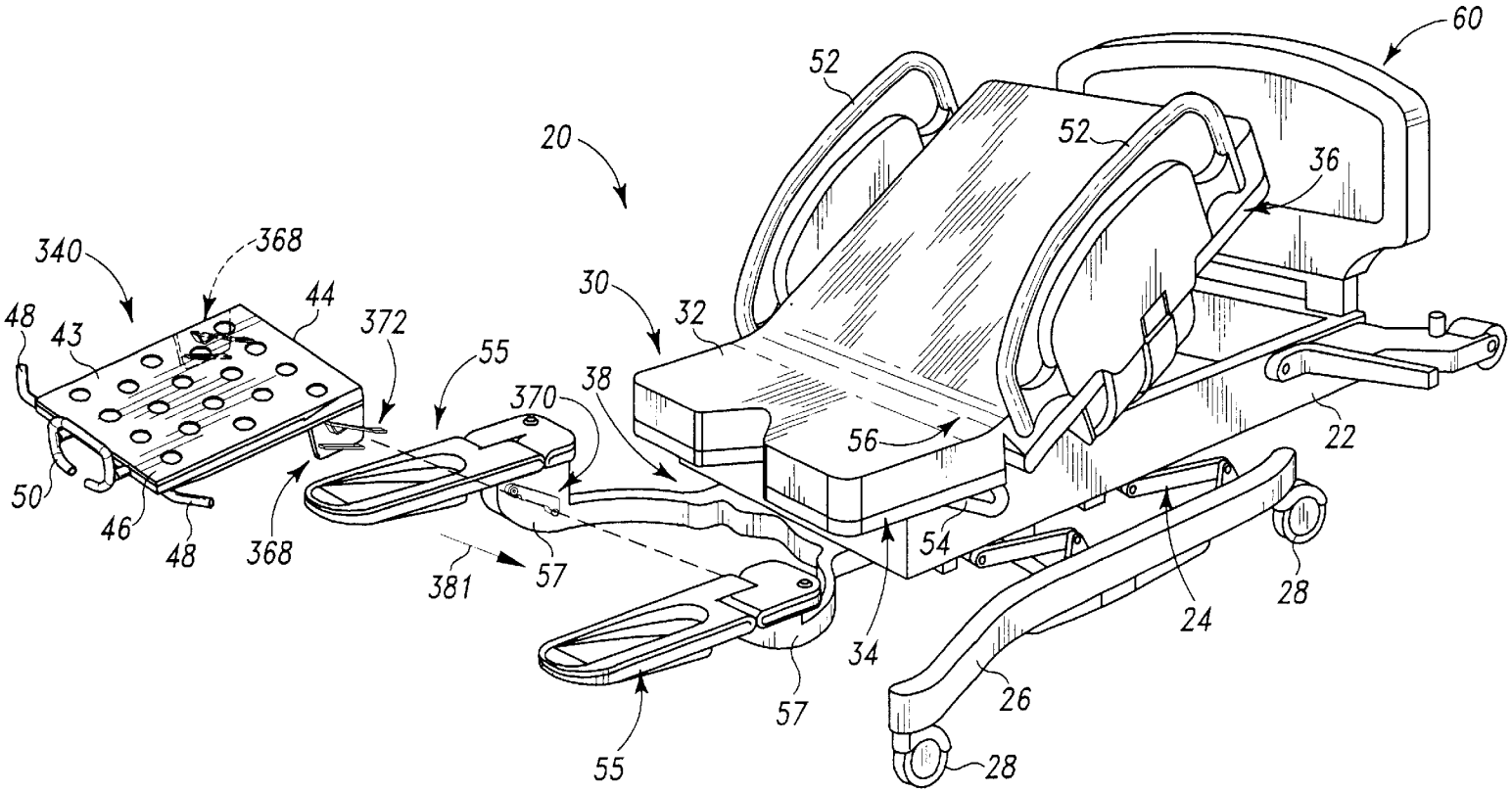
FIG. 13 is a perspective view of another alternative embodiment of the attachment mechanism of the removable foot section of the present invention, the attachment mechanism including a first portion on the foot section of the bed and a second portion on the patient support.
Figure 15:
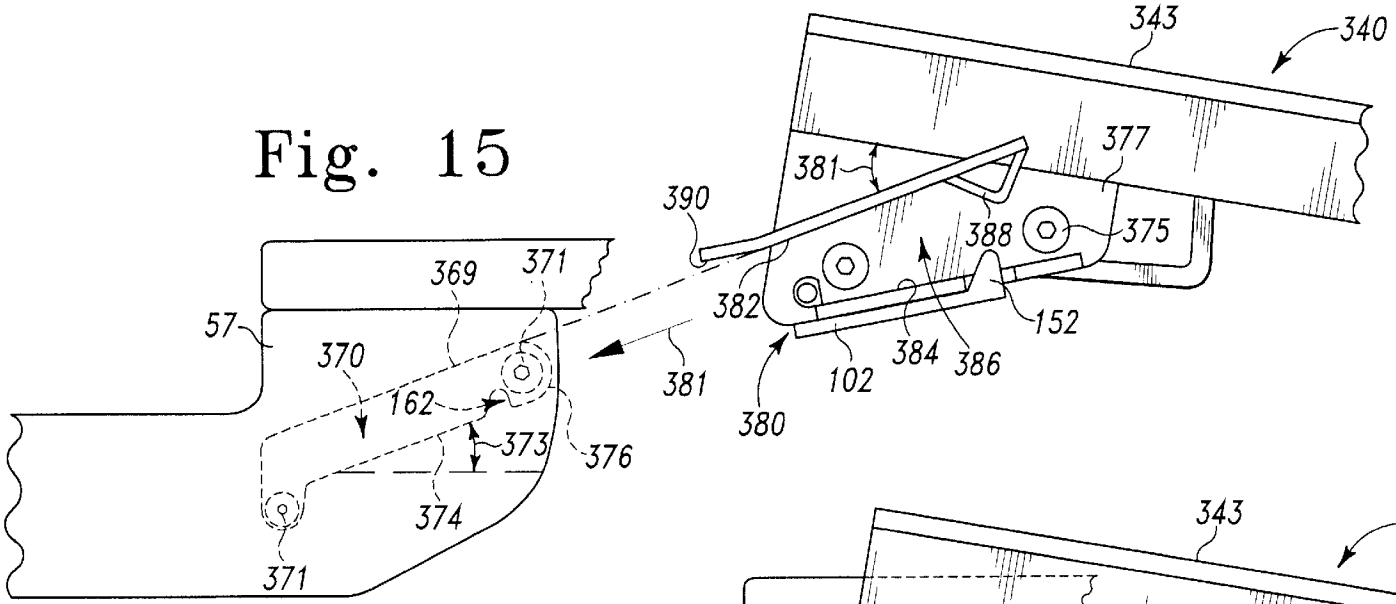
FIG. 15 is a side elevational view of the attachment mechanism of FIG. 13 showing the foot section oriented to be moved in the direction of the arrow toward the patient support to couple the foot section and patient support.

First portion 370 of each attachment mechanism 368 is coupled to support 57 at an upwardly projecting angle as shown in FIG. 13 and FIGS. 15–18. Second portions 372 of each attachment mechanism 368 are similar to guide tracks 80 discussed above except that the guide tracks 380 are aligned at a steeper downward angle illustrated by angle 381 in FIG. 15 relative to top surface 343 of the foot section 340. Therefore, foot section 340 is installed on to patient support 30 by moving foot section 340 toward the patient support 30 at a downwardly directed angle in the direction of arrow 381 as shown in FIGS. 13 and 15. Illustratively, the angle of the path of travel is about 20° downwardly relative to horizontal. It is understood that this angle may be between about 10° and about 80°.

FIGS. 14–18 illustrate the foot section attachment mechanism 368 in more detail. The foot section attachment mechanism 368 includes two guide members 370 coupled to the supports 57 of the main frame 22 by fasteners 371. One guide member 370 is coupled to support 57 on each side of the bed 20, and two guide tracks 380 coupled to the foot section 340, one on each side of the foot section 340. Although the guide members 370 are coupled to the main frame 22 in this particular embodiment, they may very well be coupled instead to the seat section 34 which is rigidly mounted to the main frame 22. Since the construction and the operation of the two guide members 370 and the two guide tracks 380 is similar, only one guide member and one guide track will be described herein in the interest of brevity. It will be understood that the construction and the operation of the other guide member and the other guide track is similar. The two guide members 370 and the two guide tracks 380 are sometimes referred to herein as the cooperating interactive members.

Each guide track 380 includes a lip or ramp portion 390 near its entrance 392. The ramp portion 390 engages a leading edge 376 of the guide member 370 during insertion of the foot section 340 into the bed 20 to direct the guide member 370 into the guide track 380. The guide member 370 includes a first upwardly-facing surface portion 372 on an upper side thereof and a second downwardly-facing surface portion 374 on an underside thereof, both surface portions 372 and 374 extending at an upwardly directed angle 373 relative to a horizontal plane defined by the upwardly-facing surface of the seat section 34. The guide track 380 coupled to the foot section 340 includes a first downwardly-facing surface portion 382 on an upper side thereof extending generally at an angle 381 with respect to the upwardly-facing surface 343 of the foot section 340, and a second upwardly-facing surface portion 384 on a lower side which also extends at a non-parallel angle relative to the upwardly-facing surface 343 of the foot section 340. The first downwardly-facing surface portion 382 and the second upwardly-facing surface portion 384 of the guide track 380 form a diverging guide channel 386 into which the guide member 370 extends when the foot section 340 is inserted into the bed 20 in the direction of arrow 381. The first generally-inclined, downwardly-facing surface portion 382 of the guide track 380 includes a downwardly-projecting ramp portion 388 near its foot end 394 which engages the leading edge 376 of the guide member 370 when the foot section 340 is inserted into the bed 20 to cause the first generally-inclined, downwardly-facing surface portion 382 of the guide track 380 to move away from the first upwardly-facing surface portion 372 of the guide member 370, and to cause the second upwardly-facing surface portion 384 of the guide track 380 to move closer to the downwardly-facing surface portion 374 of the guide member 370. This, in turn, cause the upwardly-facing surface 343 of the foot section 340 to be aligned in substantially the same plane with the seat support 34 of the patient support 30.

The foot section 340 also includes a foot section locking mechanism 100 as best shown in FIGS. 7 and 8 and described above. The foot section locking mechanism 100 locks the foot section 340 to the patient support 30 when the foot section 340 is fully inserted into the bed 20 and the upwardly-facing surface 343 of the foot section 340 is aligned with the seat support 34 of the patient support 30.

Figure 14:
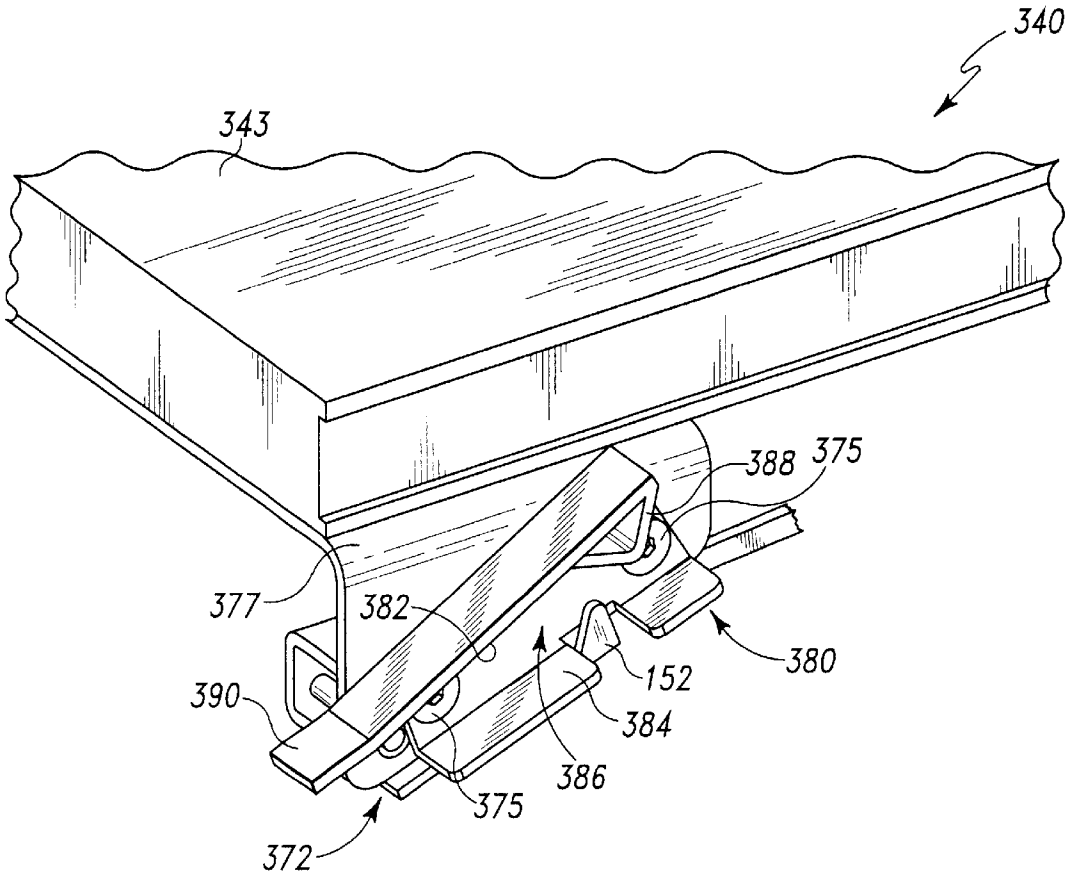
FIG. 14 is a perspective view of the first portion of the attachment mechanism of FIG. 13.

As shown in FIG. 14, the second portion 372 of attachment mechanism 368 is mounted to a downwardly extending plate 373 of foot section 340 by suitable fasteners 375. Plate 373 may be coupled to foot section 340 by suitable fasteners such as bolts, screws, rivets, or by welding.

FIG. 15 illustrates the movement of foot section 340 toward the patient support 30 during installation of the foot section 340. Foot section 340 moves downwardly in the direction of arrow 381 in order to install the foot section 340 on to the patient support 30. Leading ramp portion 390 of track 380 is configured to engage the upper surface 372 or the front surface 376 of guide member 370 as the foot section 340 approaches the guide member 370. Therefore, ramp portion 390 and downwardly facing surface 382 slide over upwardly facing surface 372 so that guide member 370 moves into channel 386. During installation of the foot section 340, top surface 343 is aligned at a plane which is transverse to a plane of seat support 34. The angled top surface 343 therefore provides a visual indication to the caregiver that the foot section 340 is not fully inserted and latched into the patient support 30.

Figure 16:
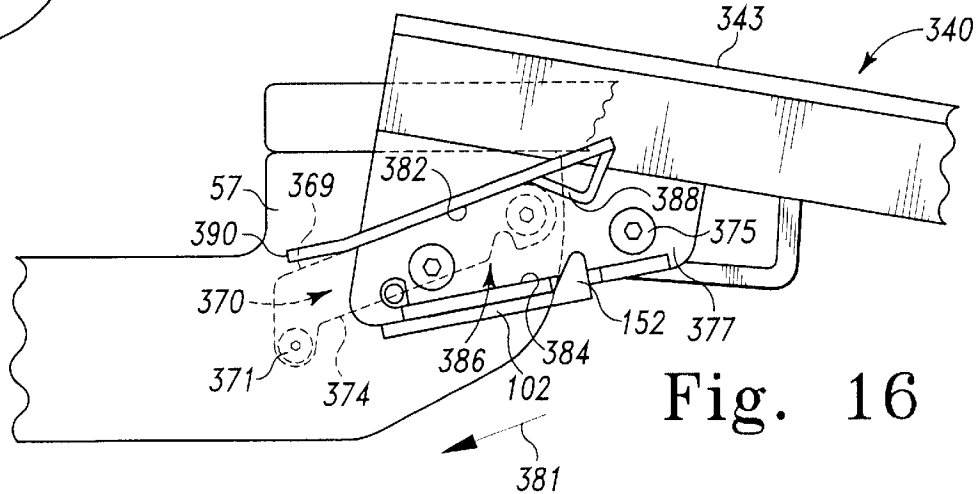
FIG. 16 is a side elevational view similar to FIG. 15 showing the orientation of the foot section relative to the patient support when the first and second portions of the attachment mechanism initially contact.
Figure 17:
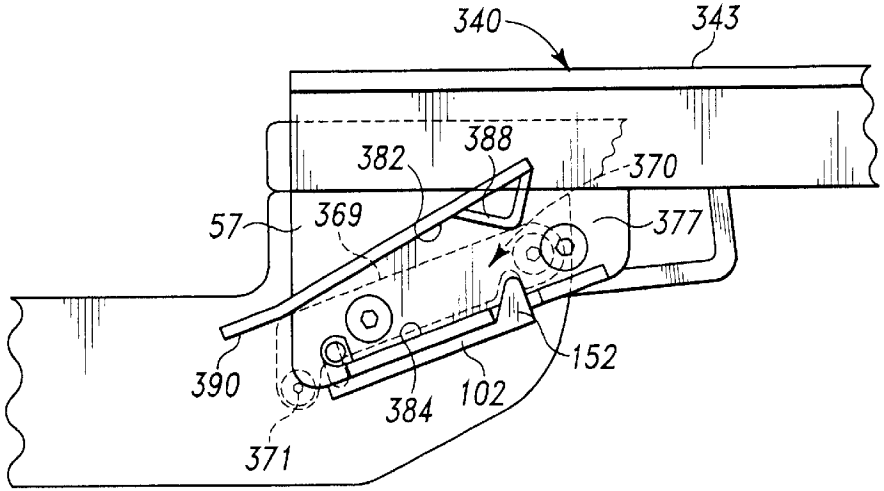
FIG. 17 is a side elevational view similar to FIG. 16 showing the orientation of the foot section relative to the patient support when the first and second portions of the attachment mechanism are coupled to couple the foot section and patient support.

FIG. 16 illustrates the foot section partially inserted on to the guide members 370. The downwardly facing surface 382 engages the upwardly facing surface 372 in the orientation of FIG. 16. Top surface 343 is still aligned in a transverse plane relative to seat section 34 of the patient support 30 to show that the foot section 340 is not latched. As the foot section 340 continues movement in the direction of arrow 381 from the position shown in FIG. 16 to the position shown in FIG. 17, the ramp portion 388 engages the leading edge 376 of guide 370 to move surface 382 upwardly away from surface 372 of guide member 370 as shown in FIG. 17. Triangular portion 152 of latch bar 102 enters the slot 362 formed in guide member 370 to secure the foot section 340 to the patient support 30 as discussed above in detail with reference to the first embodiment. When in the latched position of FIG. 17, the top surface 343 of foot section 340 is located in generally the same plane as the seat section 34 of patient support 30.

Thus, the foot section attachment mechanism 368 is configured such that the upper surface 343 of the foot section 340 will not become parallel with the seat section 34 until the foot section 340 is fully inserted into the opening 38 in the seat section 34. Upon full insertion of the foot section 340 into the opening 38, the locking mechanism 100 automatically locks the foot section 340 to the rest of the bed 20. Therefore, the foot section attachment mechanism 368 provides the caregiver with a visual indication (i.e., the orientation of the upper surface 343 of the foot section 340) regarding whether the foot section 340 is properly attached to the rest of the bed 20.

Figure 18:
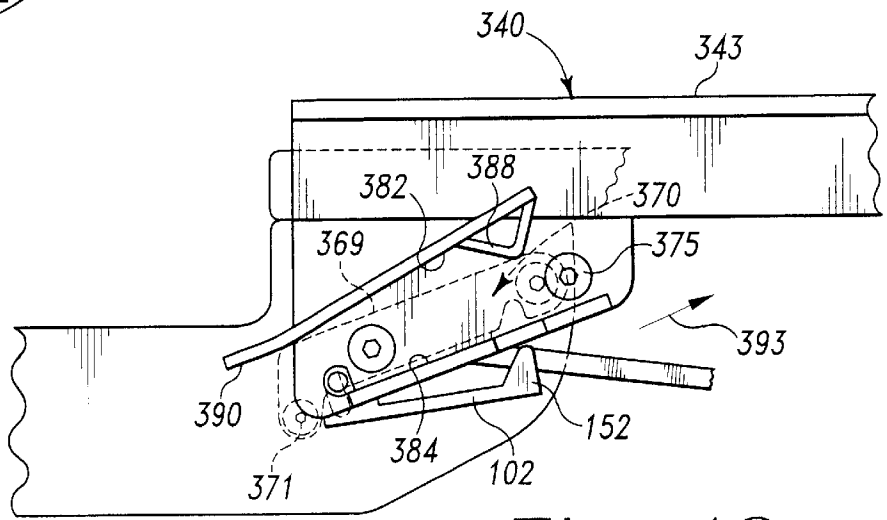
FIG. 18 is a side elevational view similar to FIG. 17 showing the orientation of the foot section relative to the patient support when the foot section is uncoupled from the patient support.

FIG. 18 illustrates the position of latch bar 102 and triangular portion 152 when the release handle 174 is actuated to unlatch the foot section 340. Therefore, when in the unlatched position of FIG. 18, foot section 340 can be removed by moving the foot section 340 at an upwardly directed angle illustrated by arrow 393.

As discussed above, the foot section 340 moves along a path of travel that includes both vertical and horizontal components. Therefore, installation of the foot section 340 is different from the substantially horizontal path of travel of the foot section shown in U.S. Pat. No. 5,926,878 and from the substantially vertical path of travel of the foot section shown, for example, in U.S. Pat. No. 5,226,187 and U.S. Pat. No. 5,157,800.

FIGS. 19–27 illustrate an alternative embodiment of a foot section attachment mechanism 468 that includes some features similar to the foot section attachment mechanism 368 shown in FIGS. 13–18. Those elements in FIGS. 19–27 identified by reference numbers identical to those in FIGS. 13–18 perform the same or similar function. In the FIG. 19 embodiment, the detachable mattress section 58 of FIG. 1 is shown removed from the foot section 440 for clarity. The attachment mechanism 468 includes a pair of first portions, illustratively guide members 470, coupled to the foot section 440. More particularly, one guide member 470 is supported proximate each longitudinally extending side edge 441 and 442 of the foot section 440. The attachment mechanism 468 further includes a pair of second portions, illustratively guide tracks 480, coupled to the supports 57 of the main frame 22.

Since the construction and the operation of the two guide members 470 and the two guide tracks 480 are similar, only one guide member 470 and one guide track 480 will be described herein in the interest of brevity. It will be understood that the construction and the operation of the other guide member 470 and the other guide track 480 are substantially similar. The two guide members 470 and the two guide tracks 480 are sometimes referred to herein as cooperating engagement members.

Figure 20:
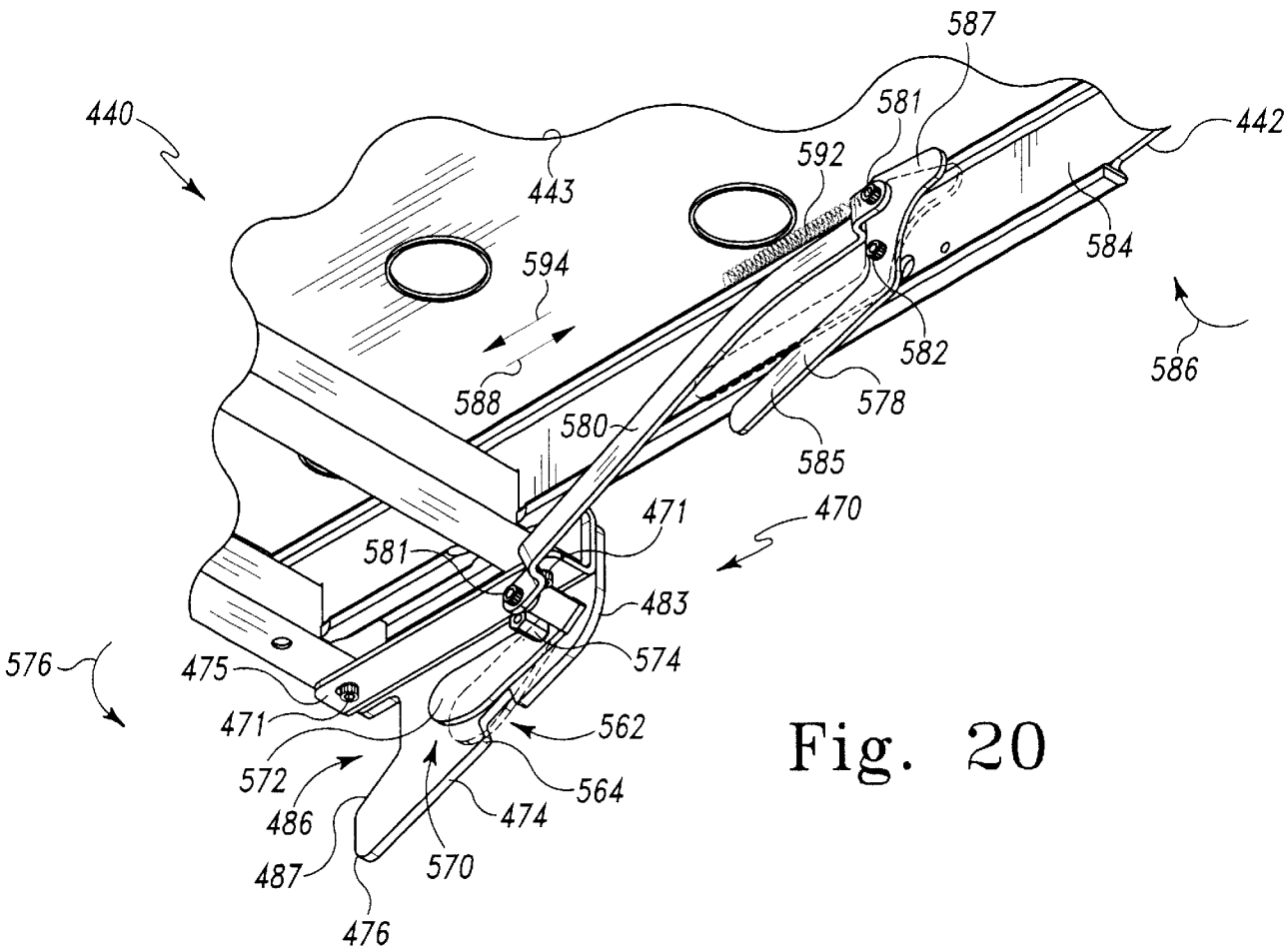
FIG. 20 is a perspective view of the first portions of the attachment mechanism and the locking mechanism of FIG. 19, with an active position of the release handle and the detent release shown in phantom.

FIGS. 20–27 illustrate the foot section attachment mechanism 468 in greater detail. As shown in FIG. 20, the guide member 470 is secured through conventional means, such as welding or fasteners (not shown), to a mounting bracket 475. The mounting bracket 475, in turn, is illustratively secured to the foot section 440 by conventional fasteners, such as bolts 471. The guide member 470 extends downwardly from the mounting bracket 475 and substantially perpendicular to a top surface 443 of the foot section 440.

Figures 24, 25:
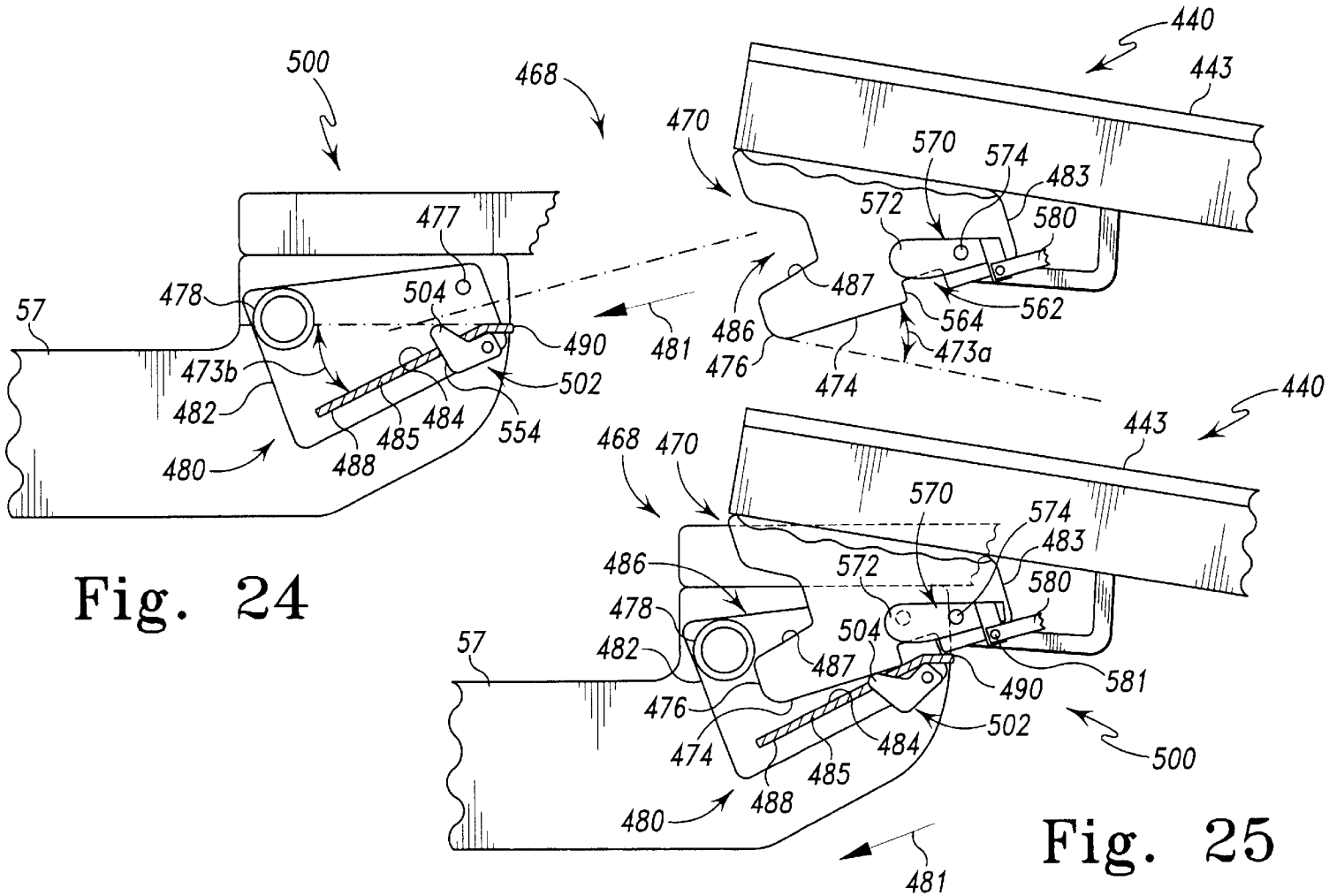
FIG. 24 is a side elevational view, in partial section, of the attachment mechanism and locking mechanism of FIG. 19 showing the foot section oriented to be moved in the direction of the arrow toward the patient support to couple the foot section and the patient support.
FIG. 25 is a side elevational view, in partial section, similar to FIG. 24 showing the orientation of the foot section relative to the patient support when the first and second portions of the attachment mechanism initially contact.

The guide member 470 includes a downwardly-facing surface portion 474 on an underside thereof, the surface portion 474 extending at an upwardly directed angle 473*a*, from a head end or leading edge 476 to a foot end or trailing edge 483, relative to a plane defined by, and extending parallel to, the upwardly-facing top surface 443 of the foot section 440 (FIG. 24). As such, the surface portion 474 is positioned a first distance from the support surface 443 of the leading edge 476 and a second distance from the support surface 443 at the trailing edge 483, wherein the first distance is greater than the second distance.

Figure 19:
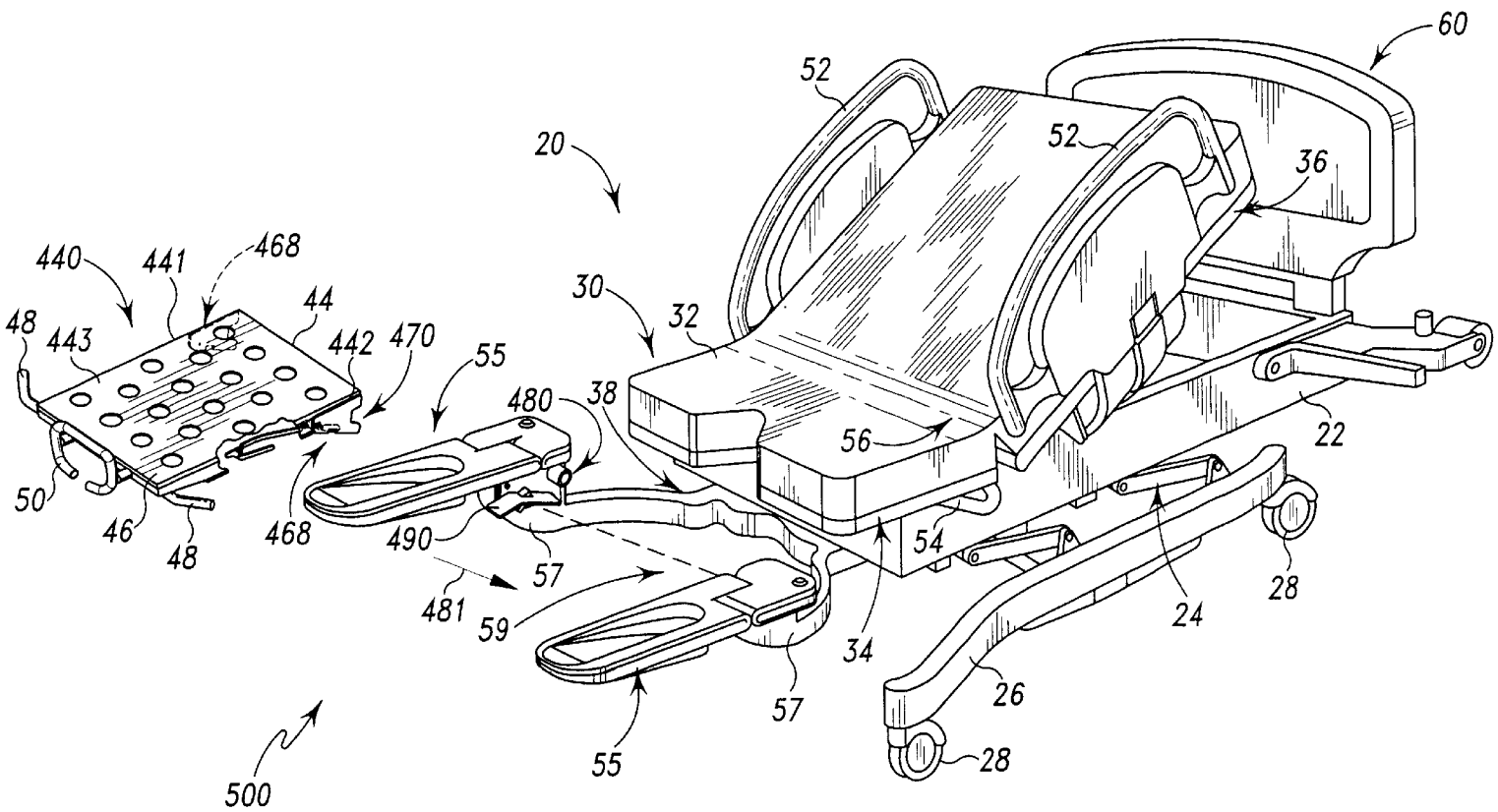
FIG. 19 is a perspective view of a further alternative embodiment of the removable foot section of the present invention including an attachment mechanism and a locking mechanism, both mechanisms including a first portion on the foot section of the bed and a second portion on the patient support.
Figure 21:
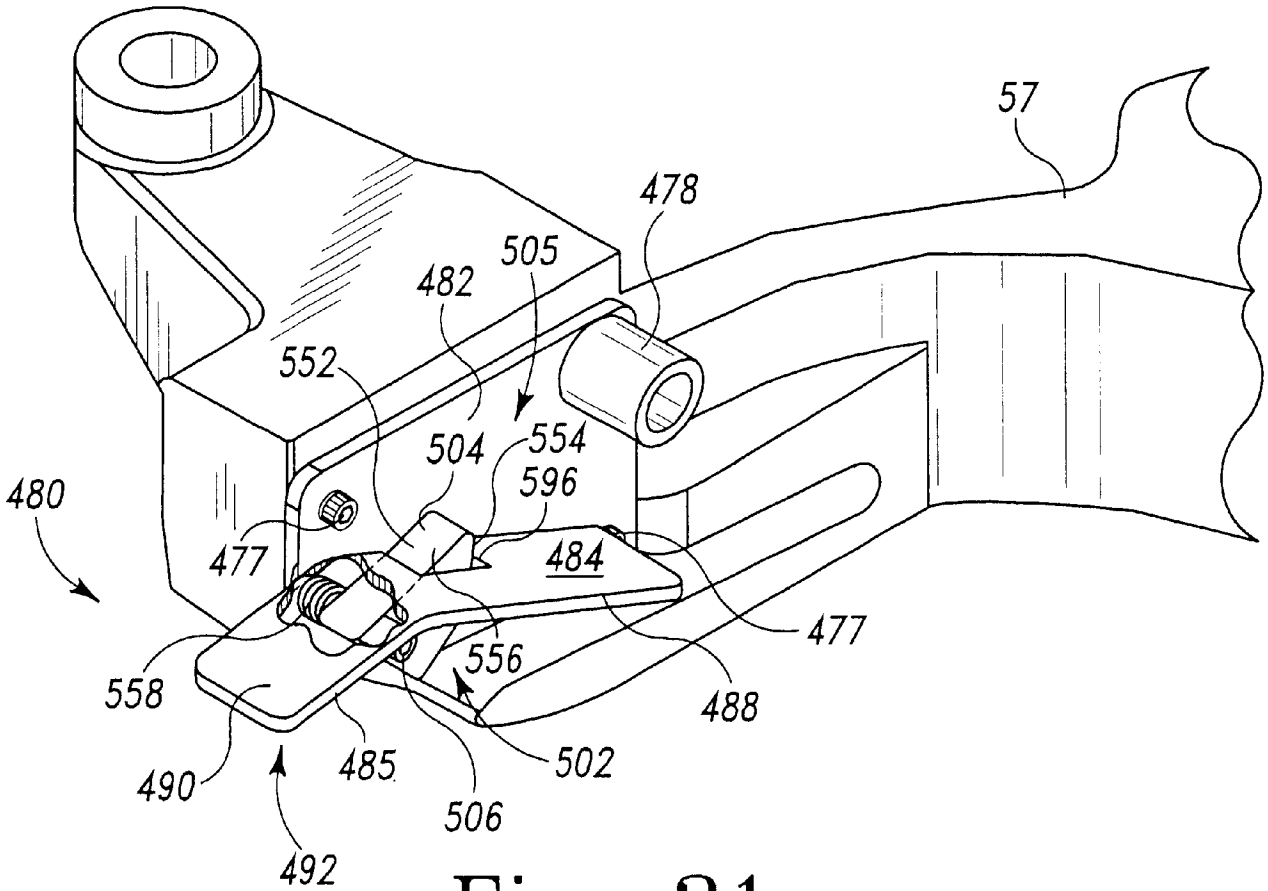
FIG. 21 is a perspective view of the second portions of the attachment mechanism and the locking mechanism of FIG. 19.

Referring further to FIG. 21, the guide tracks 480 of the attachment mechanism 468 each illustratively include a track member 485 supported by a mounting member or bracket 482 which, in turn, is secured to one of the supports 57 by conventional fasteners, such as bolts 477. As illustrated in FIG. 19, the supports 57 define a yoke 59 forming a portion of the main frame 22, wherein the guide tracks 480 face each other. Although the guide tracks 480 are coupled to the main frame 22 in this particular embodiment, they may be coupled instead to the seat section 34 which is rigidly mounted to the main frame 22.

Each track member 485 includes a main portion 488 and a lip or ramp portion 490 near its entrance 492. The main portion 488 of the track member 485 coupled to the support 57 includes an upwardly-facing surface portion 484 which extends at a non-parallel angle 473*b* relative to a substantially horizontal plane defined by the upwardly-facing surface 32 of the seat section 34 (FIG. 24). The ramp portion 490 engages the leading edge 476 of the guide member 470 during insertion of the foot section 440 into the bed 20 to direct the guide member 470 into the guide track 480.

As detailed above, the surface portion 474 of the guide member 470 is inclined relative to the top surface 443 of the foot section 440 by the angle 473*a*, while the surface portion 484 of the guide track 480 is inclined relative to the surface 32 of the seat section 34 by the angle 473*b*. More particularly, when both the surface 443 of the foot section 440 and the surface 32 of the seat section 34 are positioned substantially horizontal, then the surface portion 474 of the guide member 470 and the surface portion 484 of the guide track 480 are angled from horizontal by angles 473*a* and 473*b*, respectively. The angle 473*a* is substantially equal to the angle 473*b* and is illustratively approximately 20°. However, it should be appreciated that this angle may be within a range of about 10° to about 80°. In a manner similar to that described above with respect to the foot section 340 of FIGS. 15–18, the foot section 440 is installed onto the patient support 30 by moving the foot section 440 toward the patient support 30 at a downwardly directed angle in the direction of arrow 481 as illustrated in FIGS. 19 and 24. The angle of the path of travel illustratively is about 20° downwardly relative to horizontal.

Figure 26:
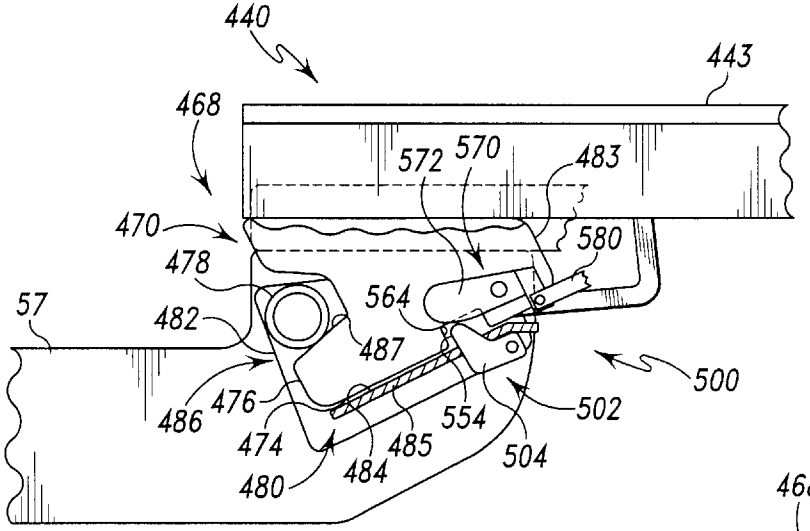
FIG. 26 is a side elevational view, in partial section, similar to FIG. 25 showing the orientation of the foot section relative to the patient support when the first and second portions of the attachment mechanism are coupled, and the first and second portions of the locking mechanism releasably lock the foot section to the patient support.

The mounting bracket 482 of the guide track 480 supports a locating member, preferably a peg 478, for receipt within a retaining slot 486 formed within the leading edge 476 of the guide member 470. The peg 478 illustratively is of a cylindrical shape and is formed of a durable and resilient material, such as a thermoplastic or elastomer. The peg 478 engages the retaining slot 486 when the foot section 440 is inserted into the bed 20 to cause the upwardly facing surface portion 484 of the track member 485 to be substantially aligned with the downwardly facing surface portion 474 of the guide member 470. Moreover, as illustrated in FIGS. 25 and 26, the peg 478 is engagable with an upwardly facing inclined wall 487 of the retaining slot 486, thereby causing the generally inclined, downwardly-facing surface portion 474 of the guide member 470 to move closer to the upwardly-facing surface portion 484 of the guide track 480. This, in turn, causes the upwardly-facing surface 443 of the foot section 440 to be aligned in substantially the same plane with the seat support 34 of the patient support 30.

The foot section 440 further includes a foot section locking mechanism 500 as best illustrated in FIGS. 20–23. The foot section locking mechanism 500 locks the foot section 440 to the patient support 30 when the foot section 440 is fully inserted into the bed 20 and the upwardly-facing surface 443 of the foot section 440 is substantially aligned with the upwardly-facing surface 32 of the patient support 30 (FIG. 26). The foot section locking mechanism 500 includes a pair of latches 502 supported by the guide tracks 480 of the attachment mechanism 468.

Since the two latches 502 are mirror images of each other, only one latch 502 will be described herein in the interest of brevity. It should be understood that the construction and operation of the other latch 502 is substantially similar. Each latch 502 includes a detent 504 pivotally mounted by a pivot shaft 506 on one of the mounting brackets 482. A generally triangular portion 552 is supported by a first end 505 of the detent 504.

Figure 27:
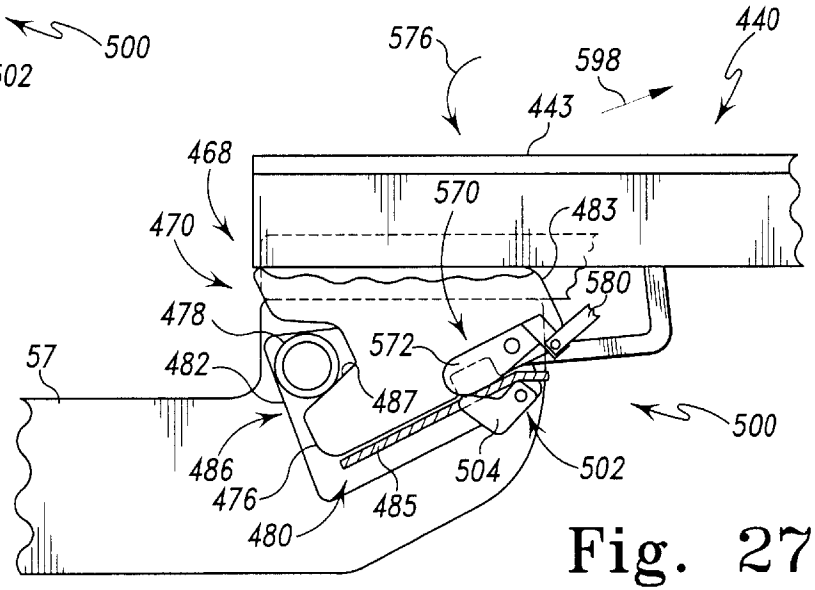
FIG. 27 is a side elevational view, in partial section, similar to FIG. 26 showing the orientation of the foot section relative to the patient support when the first and second portions of the locking mechanism unlock the foot section for movement relative to the patient support.

The detent 504 is movable between a first, locked position and a second, unlocked position. The first, locked position is defined when the generally triangular portion 552 of the detent 504 enters a locking recess or slot 562 in the guide member 470 by passing through an opening 596 formed within the upwardly-facing surface portion 484 of the guide track member 485 to lock the foot section 440 to the patient support 30 when the foot section 440 is fully inserted into the bed 20 and the upwardly-facing surface 443 of the foot section 440 is aligned with the upwardly-facing surface 32 of the patient support 30 (FIG. 26). The second, unlocked position is defined when the triangular portion 552 of the detent 504 is out of the locking slot 562 to release the foot section 440 for movement (FIG. 27). A biasing member, illustratively a spring 558, is operatively connected to the detent 504 and biases the detent 504 toward the first operative position. The spring 558 comprises a conventional torsion spring concentrically positioned on the pivot shaft 506 intermediate the mounting bracket 482 and the detent 504.

In the illustrative embodiment, the triangular portion 552 supported by the first end 505 of the detent 504 is formed integrally therewith. The triangular portion 552 includes a first generally vertical side 554 adapted for engaging a first generally vertical side 564 of the locking slot 562, and a second generally inclined side 556 adapted for engaging the downwardly-facing surface portion 474 of the guide member 470 as the foot section 440 is being coupled to the patient support 30 (FIG. 20). More particularly, during attachment of the foot section 440 to the rest of the bed 20, the inclined side 556 of the detent 504 cams against the surface portion 474 of the guide member 470 thereby pivoting the latch 502 downwardly against the bias of the spring 558 until the triangular portion 552 of the detent 504 aligns with the locking slot 562 in the guide member 470 (FIG. 25). At this point, the spring 558 biases the detent 504 upwardly so that the triangular portion 552 is received in the locking slot 562 (FIG. 26). Thus, the spring 558 coupled to the detent 504 forces the triangular portion 552 into the retaining slot 562 in the guide member 470 to lock the foot section 440 to the patient support 30 when the foot section 440 is fully inserted into the bed 20 and the upwardly-facing surface 443 of the foot section 440 is aligned with the upwardly-facing surface 32 of the patient support 30. The first vertical side 554 of the triangular portion 552 of the detent 504 bears against the first vertical side 564 of the locking slot 562 in the guide member 470 to prevent extraction of the foot section 440 from the bed 20.

Figure 22:
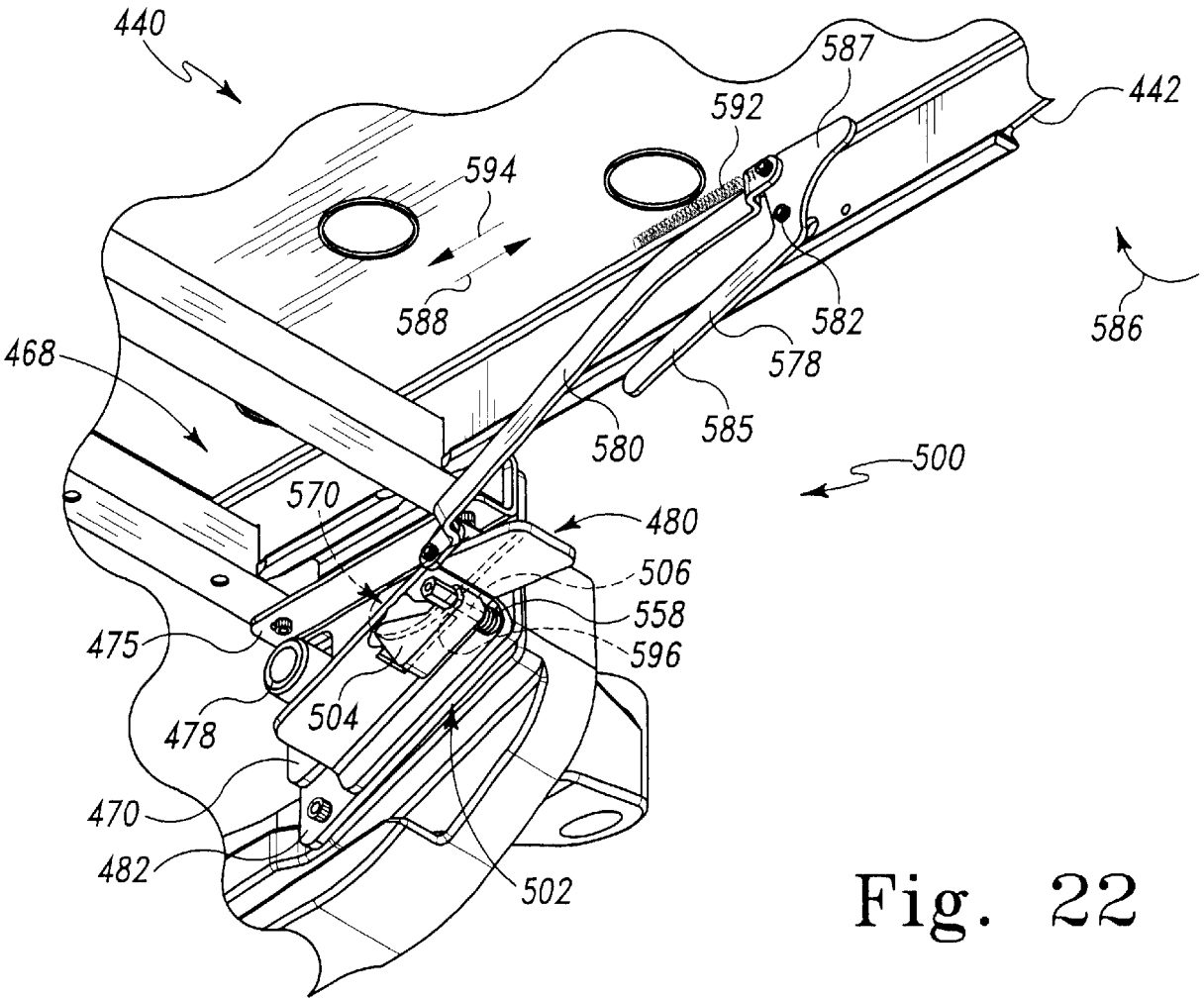
FIG. 22 is a perspective view of the attachment mechanism and the locking mechanism of FIG. 19, illustrating the foot section locked to the patient support by a detent received within a locking recess.
Figure 23:
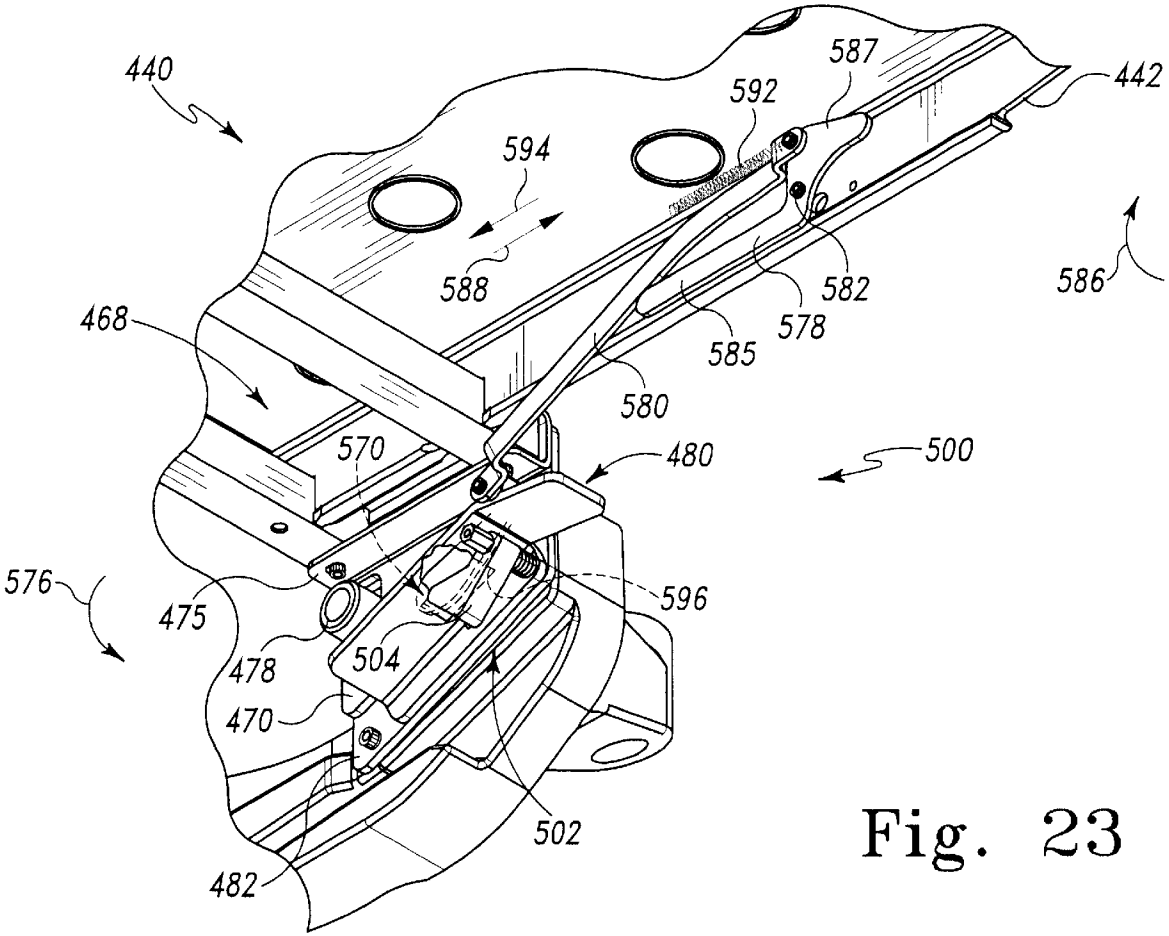
FIG. 23 is a perspective view similar to that of FIG. 22, illustrating the foot section unlocked from the patient support by a detent release forcing the detent away from the locking recess.

Referring now to FIGS. 20, 22 and 23, the locking mechanism further includes a pair of latch or detent releases 570 coupled to the foot section 440. Again, since the two latch releases 570 are mirror images of each other, only one latch release 570 will be described herein in the interest of brevity. It should be understood that the construction and operation of the other latch release 570 is substantially similar.

The detent release 570 includes a body portion 572 which is pivotably supported by a pivot shaft 574 coupled to the guide member 470 for movement between a first, rest position (FIG. 22) and a second, active position (FIG. 23). The detent release 570 engages the detent 502 when the detent release 570 is in the second position and when the removable section 440 and the patient support 30 are coupled together as illustrated in FIG. 27. The body portion 572 of the detent release 570 is eccentrically mounted to the guide member 470 about the pivot shaft 574 to provide a camming action against the detent 504 as the body portion 574 is rotated in the direction of arrow 576 away from the top surface 443 of the foot section 440.

A release handle 578 is operably connected to the detent release 570 through a connecting member or bar 580. Conventional fasteners, such as bolts 581, may be used to couple the connecting bar 580 to the release handle 578 and the detent release 570, respectively. The release handle 578 is illustrated in FIGS. 20, 22 and 23 as being supported for pivoting movement by a pivot shaft 582 coupled to a body 584 of the foot section 440. When a grip portion 585 of the release handle 578 is rotated counterclockwise about the pivot shaft 582 in the direction of arrow 586, an arm 587 of the release handle 578 causes the connecting bar 580 to move outwardly in the direction of arrow 588. As illustrated in FIGS. 23 and 27, the outward motion of the connecting bar 580, in turn, causes the detent release 570 to turn counterclockwise in the direction of arrow 576 and into engagement with the detent 504. In other words, the detent release 570 moves from the first, rest position to the second, active position. In response, the triangular portion 552 of the detent 504 disengages from the locking slot 562 to free the foot section 440 for movement. A biasing member, such as a conventional extension spring 592 illustratively connects the body 584 of the foot section 440 and the arm 587 of the handle 578. The spring 592 biases the connecting bar 580 in the direction of arrow 594 inwardly toward the detent release 570, thereby causing the detent release 570 to move toward its first, rest position (FIG. 22).

FIG. 24 illustrates the movement of the foot section 440 toward the patient support 30 during installation of the foot section 440. Foot section 440 moves downwardly in the direction of arrow 481 in order to install the foot section 440 onto the patient support 30. Leading ramp portion 490 of the guide track member 485 is configured to engage the front surface of the leading edge 476 of the guide member 470 as the foot section 440 approaches the guide track 480. Therefore, the downwardly-facing surface 474 slides over the ramp portion 490 and the upwardly-facing surface 484. During installation of the foot section 440, top surface 443 is aligned in a plane which is transverse and non-parallel to a plane of the seat section 34. The angled top surface 443 therefore provides a visual indication to the caregiver that the foot section 440 is not fully inserted and latched into the patient support 30.

FIG. 25 illustrates the guide member 470 of the foot section 440 partially inserted onto the guide tracks 480. The downwardly facing surface 474 engages the upwardly facing surface 484 in the orientation of FIG. 25. Top surface 443 is still aligned in a transverse and non-parallel plane relative to the seat section 34 of the patient support 30 to show that the foot section 440 is not latched. As the foot section 440 continues movement in the direction of arrow 481 from the position shown in FIG. 25 to the position shown in FIG. 26, the peg 478 engages the inclined wall 487 of the retaining slot 486 to move surface portion 474 of the guide member 470 downwardly toward the surface portion 484 of the guide track 480 as shown in FIG. 26. Triangular portion 552 of detent 504 enters the locking slot 562 formed in guide member 470 to secure the foot section 440 to the patient support 30 as discussed in detail above. In the latched position of FIG. 26, the top surface 443 of the foot section 440 is located in generally the same plane as the seat section 34 of the patient support 30.

Thus, the foot section attachment mechanism 468 is configured such that the upper surface 443 of the foot section 440 will not become parallel with the surface 32 of the seat section 34 until the foot section 440 is fully inserted into the opening in the seat section 34. Upon full insertion of the foot section 440 into the opening 38, the locking mechanism 500 automatically locks the foot section 440 to the rest of the bed 20. Therefore, the foot section attachment mechanism 468 provides the caregiver with a visual indication (i.e., the orientation of the upper surface 443 of the foot section 440) regarding whether the foot section 440 is properly attached to the rest of the bed 20.

FIGS. 23 and 27 illustrate the position of the latch 502, and more particularly of the triangular portion 552 of the detent 504, when the release handle 578 is actuated to unlatch the foot section 440. As detailed above, the release handle 578 is actuated by pivoting upwardly toward the top surface 443 of the foot section 440 which, in turn, causes the connecting bar 580 to move outwardly away from the detent release 570. Such movement of the connecting bar 580 causes pivoting movement of the body portion 572 of the detent release 570 downwardly into engagement with the detent 504, thereby forcing the detent 504 out of the retaining slot 562. When in the unlatched position of FIGS. 23 and 27, the foot section 440 can be removed by moving the foot section 440 at an upwardly directed angle illustrated by arrow 598 in FIG. 27.

Figure 28:
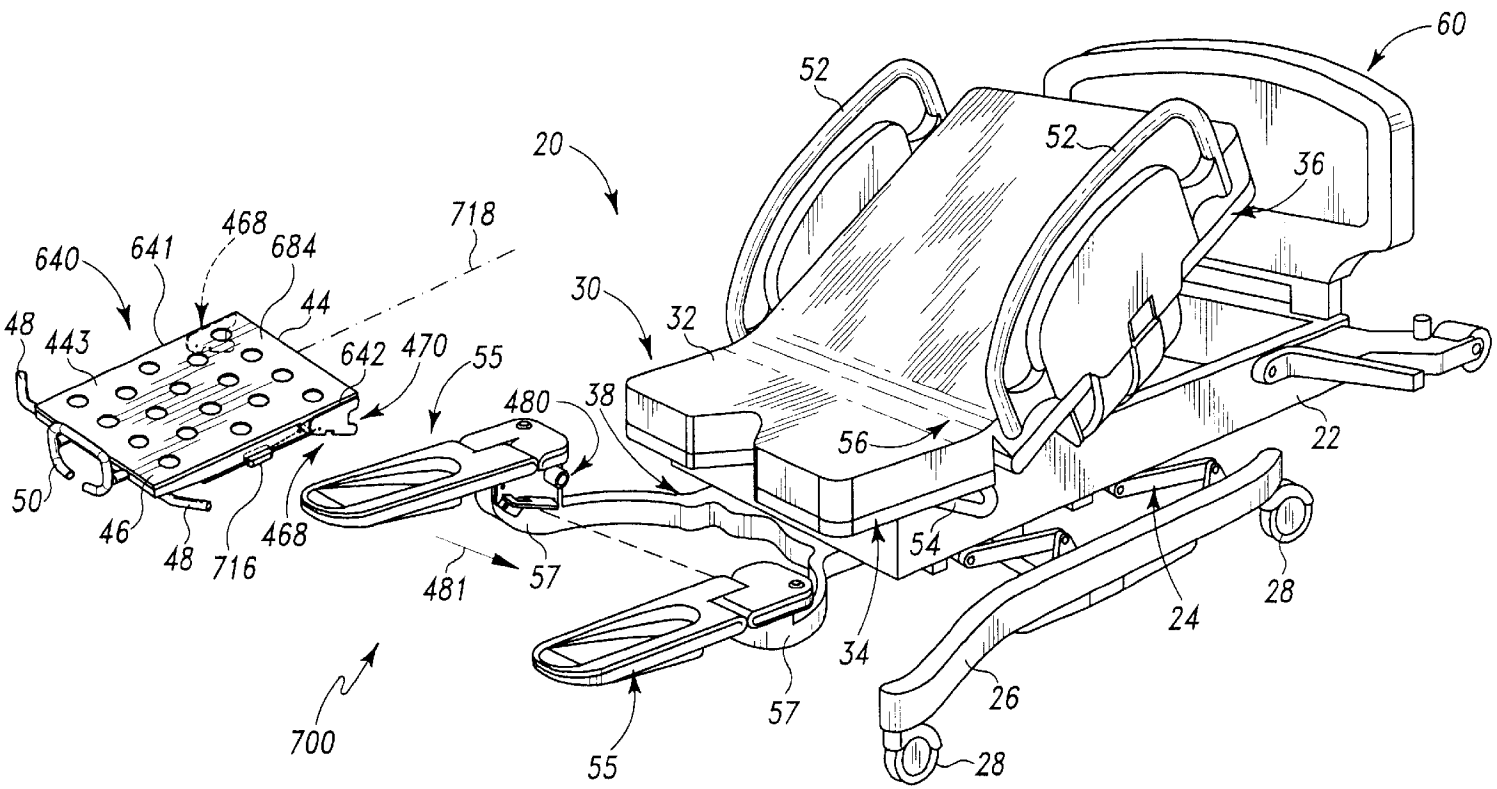
FIG. 28 is a perspective view of another alternative embodiment of the removable foot section of the present invention including release handles slidably supported by the foot section.
Figure 29:
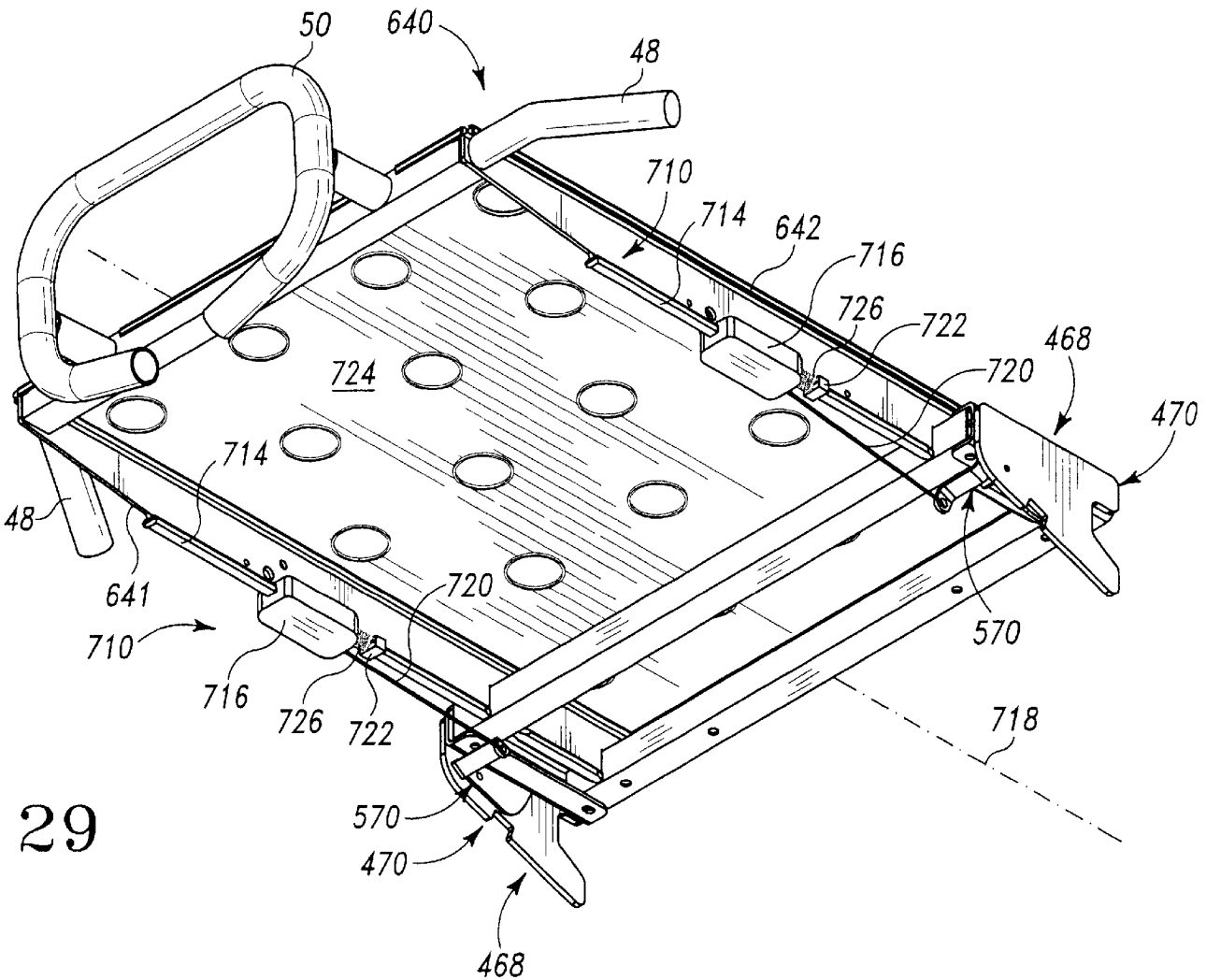
FIG. 29 is a perspective view of the removable foot section of FIG. 28.

FIGS. 28 and 29 illustrate a further embodiment of the removable foot section 640 of the present invention. The removable foot section 640 includes an identical attachment mechanism 468 as described above with respect to FIGS. 19–27. As such, those elements in FIGS. 28 and 29 identified by reference numerals identical to those in FIGS. 19–27 perform the same or similar function.

The foot section 640 includes an alternative embodiment foot section locking mechanism 700 including a pair of guide members 710 supported by the body 684 of the foot section 640. One guide member 710 is supported proximate each opposing longitudinal side edge 641 and 642 of the foot section 640. The guide members 710 each illustratively consists of a track 714. A sliding handle 716 is guided in sliding movement by each track 714 in a direction substantially parallel to the longitudinal axis 718 of the foot section 640. A connecting member, such as a cable 720, operably connects each sliding handle 716 to the body portion 572 of the detent release 570. A pair of mounting blocks 722 are coupled to a lower surface 724 of the body 712 of the foot section 640 and define ends of travel for the sliding handles 716. A spring 726 interconnects each sliding handle 716 to the mounting block 724 such that the sliding handle 716 is biased in a first, rest position. By sliding each handle 716 along its guide track 710 away from its respective mounting block 722 to a second, active position, the cable 720 causes pivoting movement of the detent release 570. The remaining elements of the locking mechanism 700 operate substantially the same as the locking mechanism 500 as described in detail above.

Although the invention has been described in detail with reference to certain illustrated embodiments, variations and modifications exist within the scope and spirit of the present invention as defined in the following claims.

What is claimed is:

1. A patient support apparatus comprising:

a patient support;

a removable section movable between a first position wherein said removable section is coupled to said patient support and a second position wherein said removable section is spaced apart from said patient support; and a locking mechanism including a detent coupled to one of said patient support and said removable section and a detent release coupled to the other of said removable section and said patient support, wherein said detent release is selectively connected to said detent when said removable section is in said first position.

2. The patient support of claim 1, further comprising an attachment mechanism including cooperating engagement members coupled to said patient support and said removable section.

3. The patient support apparatus of claim 2, wherein said attachment mechanism includes a guide member supported by said removable section and a guide track supported by said patient support.

4. The patient support apparatus of claim 2, wherein said patient support includes a planar support surface, said cooperating engagement member coupled to said removable section includes a guide member having a foot end, a head end, and a lower surface, said lower surface being positioned a first distance from said planar support surface at said head end and a second distance from said planar support surface at said foot end, said first distance being greater than said second distance.

5. The patient support apparatus of claim 3, wherein said guide track includes a lip portion located adjacent an entrance of said guide track, said lip portion configured to engage said guide member when said removable section is inserted into said patient support to direct said guide member into said guide track.

6. The patient support apparatus of claim 3, wherein said guide member includes a lower surface and a locking recess formed in said lower surface, said detent selectively positioned in said locking recess when said removable section and said patient support are coupled together.

7. The patient support apparatus of claim 3, wherein said guide member includes a retaining slot, and said guide track includes a locating member supported for receipt within said retaining slot when said removable section and said patient support are coupled together.

8. The patient support apparatus of claim 1, wherein said detent is movably supported by said patient support and said detent release is movably supported by said removable section.

9. The patient support apparatus of claim 8, wherein said detent is movable between a first position and a second position, said locking mechanism further comprising a biasing member operably connected to said detent for biasing said detent in said first position.

10. The patient support apparatus of claim 9, wherein said detent release is movable between a first position and a second position, said detent release engaging said detent when said detent release is in said second position and when said removable section and said patient support are coupled together.

11. The patient support apparatus of claim 8, further comprising a release handle operably connected to said detent release.

12. The patient support apparatus of claim 11, wherein said release handle is pivotably supported by said removable section.

13. The patient support apparatus of claim 11, wherein said release handle is slidably supported by said removable section.

14. The patient support apparatus of claim 13, wherein said removable section further comprises a guide member, said release handle supported for sliding movement by said guide member.

15. The patient support apparatus of claim 1, wherein the removable section is movable from said second position to said first position along an inclined path of travel having both horizontal and vertical components relative to a ground surface.

16. A patient support apparatus comprising:

a patient support;

a removable section;

an attachment mechanism including cooperating engagement members coupled to said patient support and said removable section, said removable section being movable between a first position wherein said removable section is coupled to said patient support by said engagement members and a second position wherein said removable section is spaced apart from said patient support; and a locking mechanism including a locking recess supported by said removable section and a detent supported by said patient support, said detent movable between a first position received within said locking recess and a second position in spaced relation to said locking recess when said removable section is coupled to said patient support by said engagement members.

17. The patient support apparatus of claim 16, wherein said locking mechanism further comprises a biasing member operably connected to said detent for biasing said detent in said first position.

18. The patient support apparatus of claim 16, further comprising a detent release which is movable between a first position and a second position, said detent release engaging said detent when said detent release is in said second position and when said removable section is coupled to said patient support by said interactive members.

19. The patient support apparatus of claim 18, further comprising a release handle operably connected to said detent release.

20. The patient support apparatus of claim 19, wherein said release handle is pivotably supported by said removable section.

21. The patient support apparatus of claim 19, wherein said release handle is slidably supported by said removable section.

22. The patient support apparatus of claim 21, wherein said removable section further comprises a guide member, said release handle supported for sliding movement by said guide member.

23. The patient support apparatus of claim 16, wherein said patient support includes a yoke having first and second supports, and said locking mechanism includes operably connected first and second detents supported on said first and second supports.

24. A patient support apparatus comprising:

a patient support;

a removable section movable between a first position wherein said removable section is coupled to said patient support and a second position wherein said removable section is spaced apart from said patient support;

a latch coupled to said patient support and movable between a first, locked position and a second, unlocked position; and a latch release coupled to said removable section, wherein movement of said latch release moves said latch between said locked position and said unlocked position when said removable section is in said first position.

25. The patient support apparatus of claim 24, wherein said latch comprises a detent supported by said patient support and a locking recess and a locking recess supported by said removable section.

26. The patient support apparatus of claim 25, wherein said detent is movable between said locked position and said unlocked position, said latch further comprising a biasing member operably connected to said detent for biasing said detent in said unlocked position.

27. The patient support apparatus of claim 25, wherein said latch release is movable between a first position and a second position, said latch release engaging said latch when said detent release is in said second position and when said removable section and said patient support are coupled together.

28. The patient support apparatus of claim 24, further comprising a release handle operably connected to said latch release.

* * * * *